United States Patent [19]

Ishikawa et al.

[11] Patent Number: 4,587,195

[45] Date of Patent: May 6, 1986

[54] METHOD OF PROCESSING SILVER HALIDE PHOTOGRAPHIC LIGHT-SENSITIVE MATERIAL

[75] Inventors: Masao Ishikawa; Shigeharu Koboshi; Masayuki Kurematsu, all of Hino, Japan

[73] Assignee: Konishiroku Photo Industry Co., Ltd., Tokyo, Japan

[21] Appl. No.: 721,781

[22] Filed: Apr. 10, 1985

Related U.S. Application Data

[63] Continuation-in-part of Ser. No. 529,726, Sep. 6, 1983, abandoned.

[30] Foreign Application Priority Data

Sep. 14, 1982 [JP] Japan ..... 57-161523

[51] Int. Cl.[4] ..... G03C 5/16

[52] U.S. Cl. ..... 430/139; 430/372; 430/486; 430/513; 430/517; 430/520; 430/521; 430/522

[58] Field of Search ..... 430/139, 372, 393, 486, 430/513, 517, 520, 521, 522

[56] References Cited

U.S. PATENT DOCUMENTS

| | | | |
|---|---|---|---|
| 2,815,284 | 12/1957 | Tausch | 430/486 |
| 3,247,127 | 4/1966 | Bailey | 430/518 |
| 3,540,887 | 11/1970 | Depoorter et al. | 430/580 |
| 3,575,704 | 4/1971 | Salesin | 430/521 |
| 3,653,905 | 4/1972 | Depoorter et al. | 430/522 |
| 3,705,036 | 12/1972 | Amano et al. | 430/372 |
| 4,232,112 | 11/1980 | Kuse | 430/393 |
| 4,336,326 | 6/1982 | Evans | 430/523 |

*Primary Examiner*—J. Travis Brown

*Attorney, Agent, or Firm*—Jordan B. Bierman

[57] ABSTRACT

A method of processing a silver halide photographic material using a color developer containing at least two kinds of triazylstilbene brightening agents having maximum fluorescent wavelengths at least 4$\mu$ apart, said material containing a sensitizing dye and an antiirradiation dye.

9 Claims, No Drawings

METHOD OF PROCESSING SILVER HALIDE PHOTOGRAPHIC LIGHT-SENSITIVE MATERIAL

This application is a continuation-in-part of Ser. No. 529,726, filed Sept. 6, 1983, now abandoned.

BACKGROUND OF THE INVENTION

1. Field of the Invention

The present invention relates to a method of processing a silver halide photographic light-sensitive material and, more detailedly, to a method thereof, wherein the improvement is made on the prevention of a color stain and particularly the prevention of a color dye stain caused in the course of processing said silver halide photographic light-sensitive material by a color developer and then by a bleach-fix bath.

2. Description of the state of the art

In general, a light-sensitive material for a color printing paper use is exposed to light through a color negative film and is applied in succession to the processing steps mainly comprising a color development by means of a paraphenylenediamine type developing agent, a bleach-fix, and washing, and thus a color print is produced.

The essential requirements for practically making such color prints are that the color reproductivity and the whiteness of the unexposed areas of such color prints, that is the so-called white-background property, should be excellent.

In recent years, a yellow, red or other colored stain is apt to occur particularly on a silver halide color photographic light-sensitive material when the light-sensitive material is processed in a color developer and then in a bleach-fix bath. The color stains of this kind will noticeably occur especially when such a substance liquated out from a light-sensitive material, e.g., a silver halide, is accumulated in a color developer and a bleach-fix bath oxidated or fatigued with an aeration is used in a regeneration process for regenerating the liquated substances. Various causes of these color stains may be considered, and inter alia, a color stain which has been popularly known is that caused by a reaction of the oxidation products of a color developing agent in a bleach-fix bath with couplers being contained in a light-sensitive material. Another stain which has also been popularly known is that substances liquated out from a light-sensitive material, components of a bleach-fix bath or the like adhere to the light-sensitive material, or permeate into an edge area, when the bleach-fix bath is concentrated in a running process. Accordingly, there have so far been well-known techniques with the purpose of solving the abovementioned problems, for example, a stain prevention technique disclosed in Japanese Patent Publication Open to Public Inspection (hereinafter referred to as Japanese Patent O.P.I. Publication) No. 102640/1976, in which an alkylamino compound is added to a bleach-fix bath; another stain prevention technique disclosed in Japanese Patent O.P.I. Publication No. 71639/1973, in which some kind of magenta couplers to be contained in a light-sensitive material is combined with a hardening agent; a further technique disclosed in Japanese Patent Examined Publication No. 23179/1976, in which an oxide of some kind of amino compounds is added to a bleach-fix bath; or the like.

Besides the abovementioned color stain prevention techniques, there have also been well known the methods for lessening the deterioration of a white background caused by a color stain, in which the spectral reflectivity of such white background areas are evenly increased by containing a brightening agent in a light-sensitive material, or by adding the same to a processing liquid.

Recently, however, from the viewpoint of an environmental pollution or an economics, color developers and bleach-fix bath tend to be regenerated to use or to be less replenished, and along with the rapid photographic processing has been adopted, such color stains tend to be increased when being processed at a high temperature not lower than 30° C. To cope with these tendencies, the conventional methods have been able to afford to prevent color stains caused with a less replenishment or with a high temperature and rapid processing and particularly stains caused by a reaction product of unreacted couplers in a light-sensitive material with the oxidants of a color developing agent, however such conventional methods have not any effect at all on stains caused by a sensitizing dye, an antiirradiation dye or the like. Accordingly, an effective prevention technique has been anticipated.

OBJECT OF THE INVENTION

Accordingly, it is an object of the invention to provide a method of processing a silver halide photographic light-sensitive material, in which the improvement is made on the prevention of a color stain caused with a less replenishment or with a high temperature and rapid processing and particularly a color stain caused by a sensitizing dye, an antiirradiation dye or the like.

SUMMARY OF THE INVENTION

The present inventors found the fact, after devoting themselves to the studies, that the abovementioned object can be achieved in the method that a silver halide photographic light-sensitive material is exposed imagewise to light and is then processed by a color developer containing at least two kinds of triazylstilbene type brightening agents of which the difference of the maximum fluorescent wavelengths λmax of the fluorescent spectra between the two brightening agents is not shorter than 4 mμ.

In the invention, a maximum fluorescent wavelength λmax means the wavelength in which the maximum fluorescent intensity is displayed.

DETAILED DESCRIPTION OF THE INVENTION

Triazylstilbene type brightening agents having the following Formula [A] are preferably used in the invention.

Formula [A]

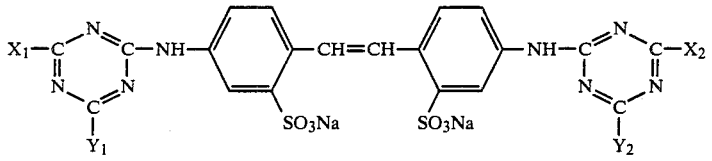

Wherein, $X_1$, $X_2$, $Y_1$ and $Y_2$ respectively represent a hydroxyl group, a halogen such as chlorine, bromine or the like, a morpholino group, an alkoxy group such as methoxy, ethoxy, or methoxyethoxy group, an aryloxy group such as phenoxy, or p-sulfophenoxy group, an alkyl group such as methyl or ethyl group, an aryl group such as phenyl or methoxyphenyl group, an amino group, an alkylamino group such as methylamino, ethylamino, propylamino, dimethylamino, cyclohexylamino, β-hydroxyethylamino, di(β-hydroxyethylamino)amino, β-sulfoethylamino, N-(β-sulfoethyl)-N'-methylamino, N-(β-hydroxyethyl)-N'-methylamino group or the like, and an arylamino group such as anilino, o-, m-, p-sulfanilino, o-, m-, p-chloranilino, o-, m-, p-toluidino, o-, m-, p-carboxyanilino, o-, m-, p-hydroxyanilino, sulfonaphthylamino, o-, m-, p-aminoanilino and the like.

The concrete examples of the compounds having the abovementioned Formula [A] may be given as follows, and it is however to be understood that the compounds shall not be limited thereto.

[Exemplified Compounds]

A-1

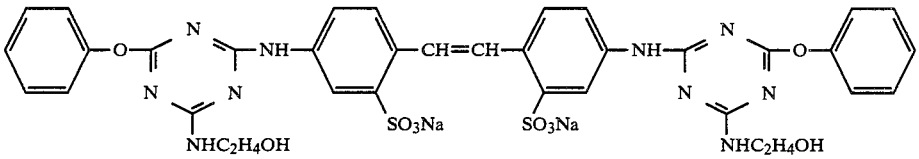

λmax = 435mμ

A-2

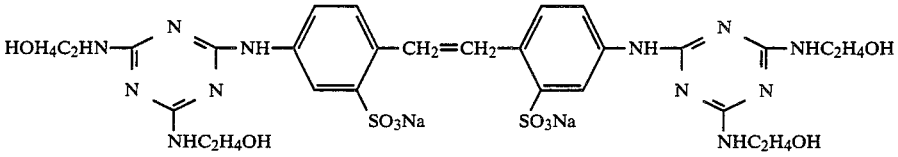

λmax = 437mμ

A-3

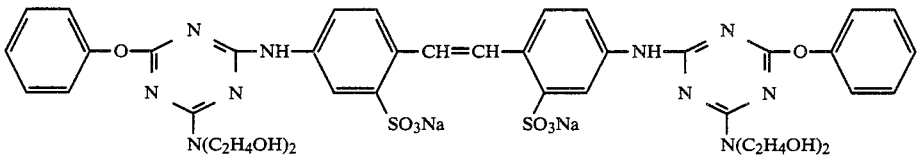

λmax = 437mμ

A-4

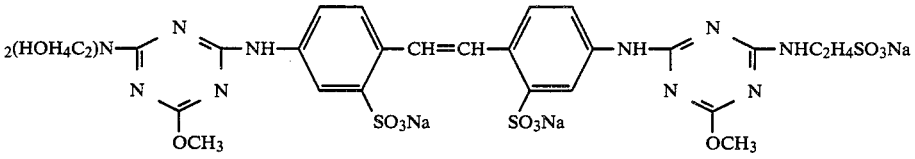

λmax = 436mμ

A-5

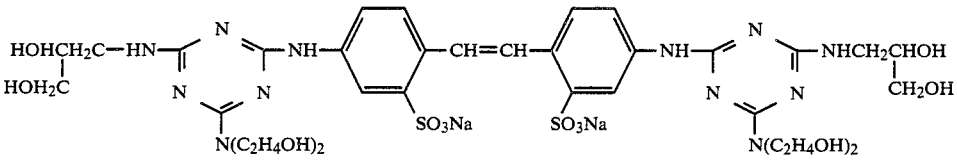

λmax = 440mμ

-continued
A-6
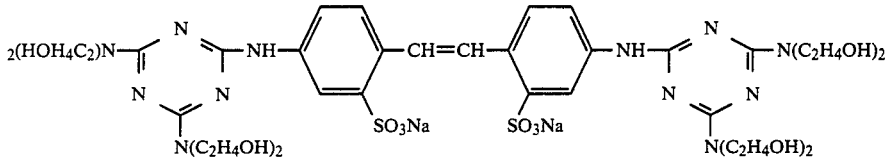
λmax = 442mμ
A-7
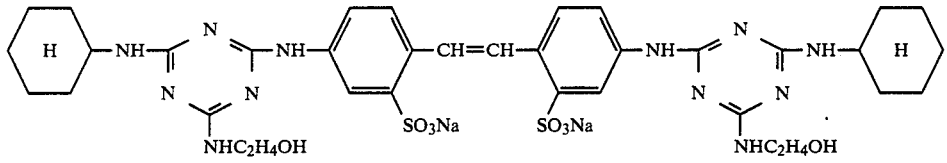
λmax = 437mμ
A-8
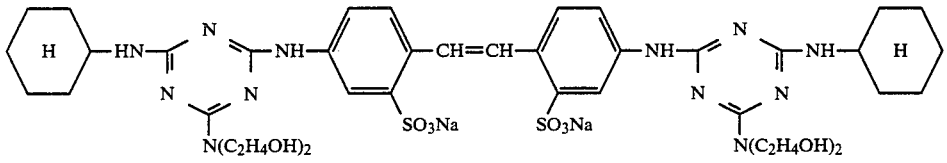
λmax = 440mμ
A-9
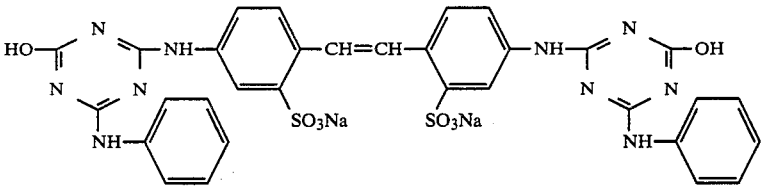
λmax = 436mμ
A-10
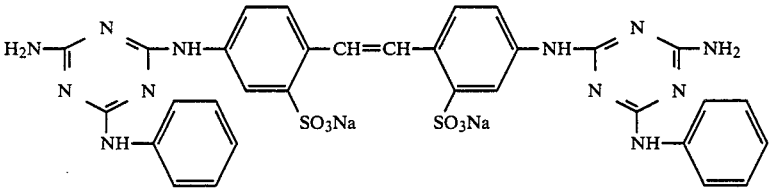
λmax = 437mμ
A-11
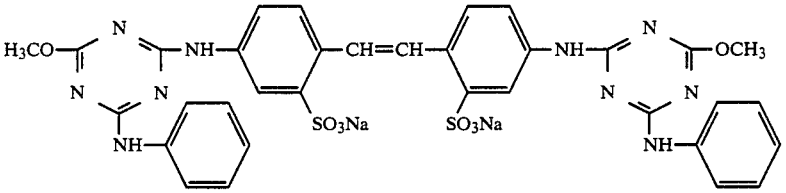
λmax = 439mμ
A-12
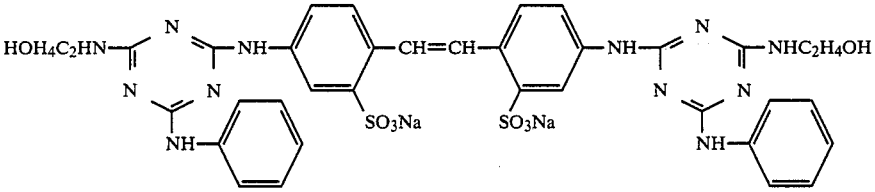
λmax = 440mμ

-continued
A-13
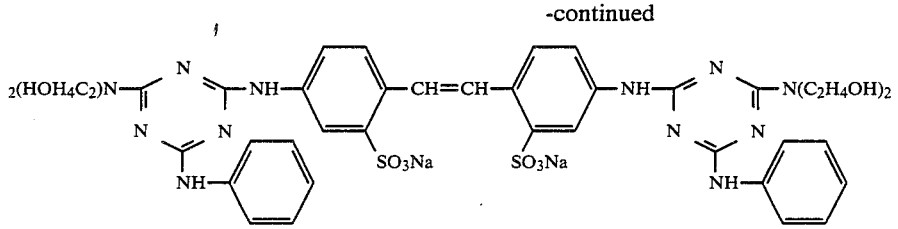
λmax = 442mμ
A-14
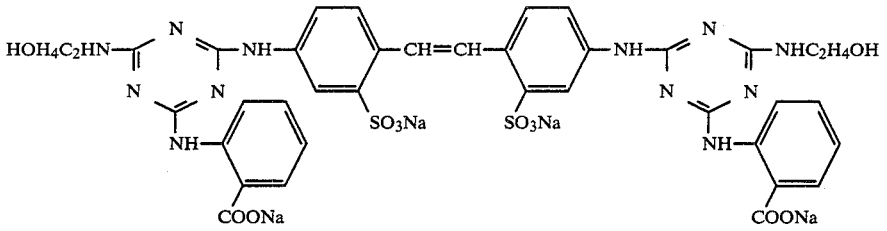
λmax = 440mμ
A-15
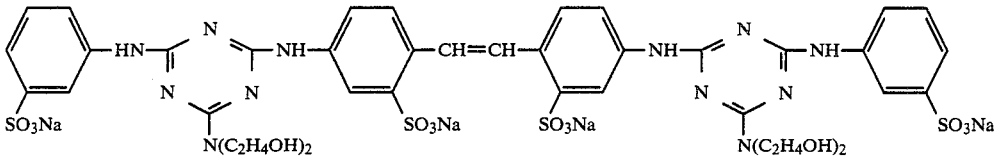
λmax = 441mμ
A-16
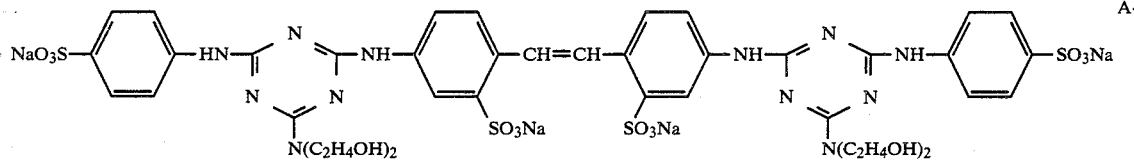
λmax = 440mμ
A-17
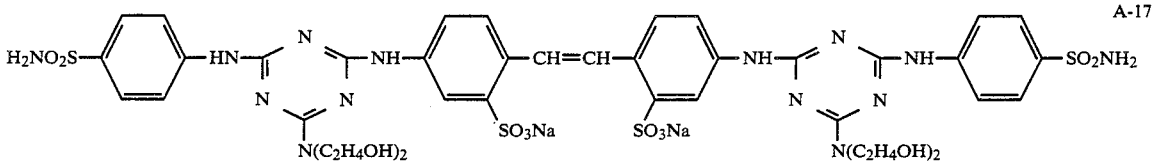
λmax = 439mμ
A-18
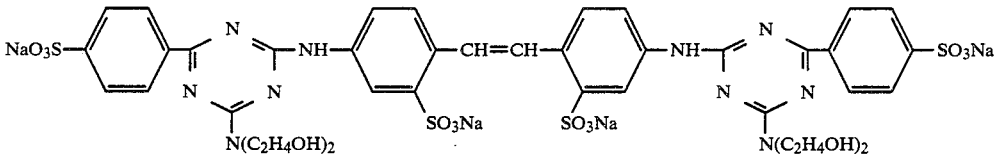
λmax = 434mμ
A-19
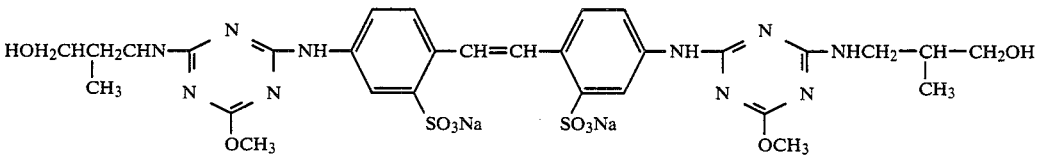
λmax = 436mμ

-continued
A-20
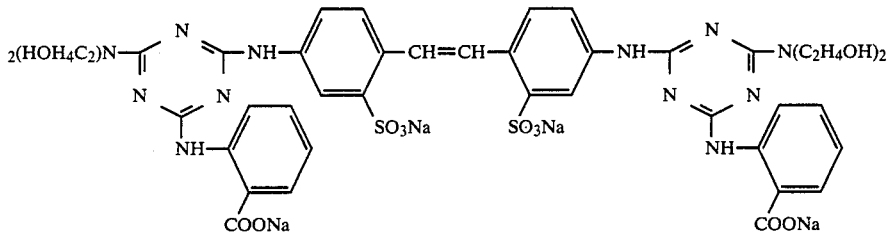
λmax = 442mμ
A-21
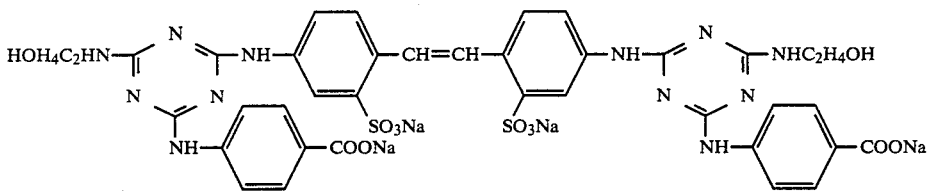
λmax = 440mμ
A-22
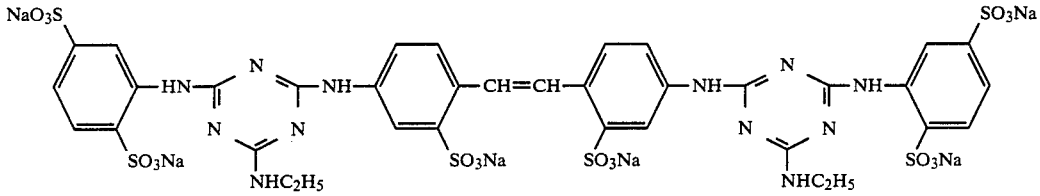
λmax = 441mμ
A-23
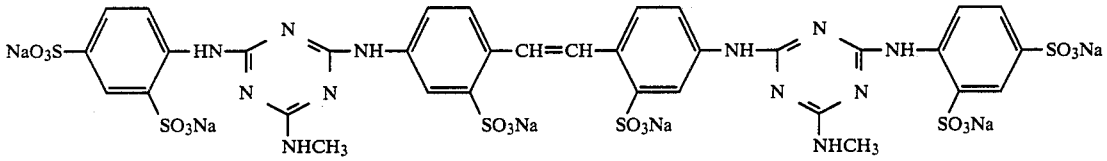
λmax = 440mμ
A-24
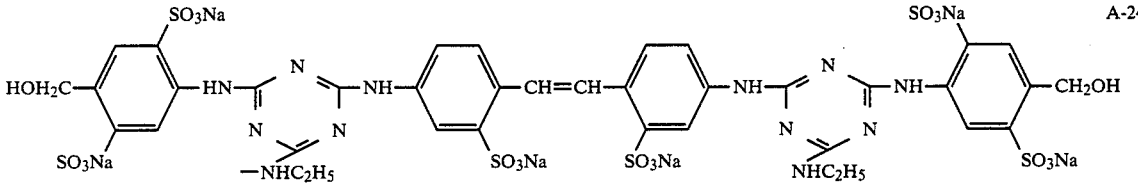
λmax = 442mμ
A-25
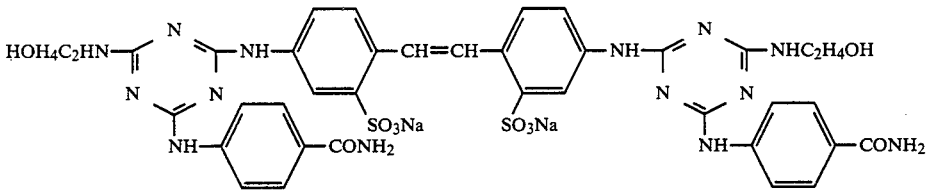
λmax = 441mμ
A-26
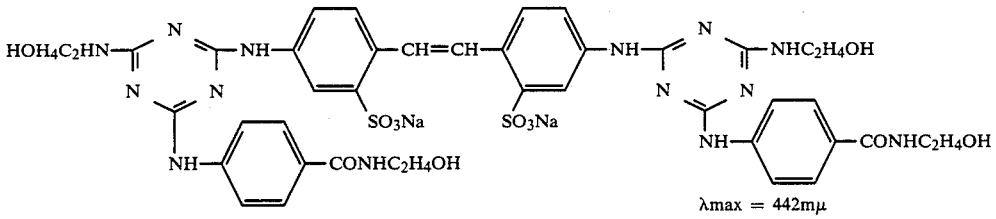
λmax = 442mμ

-continued
A-27
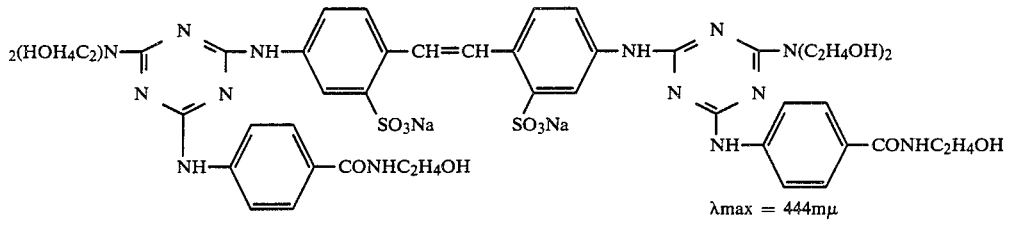
λmax = 444mμ
A-28
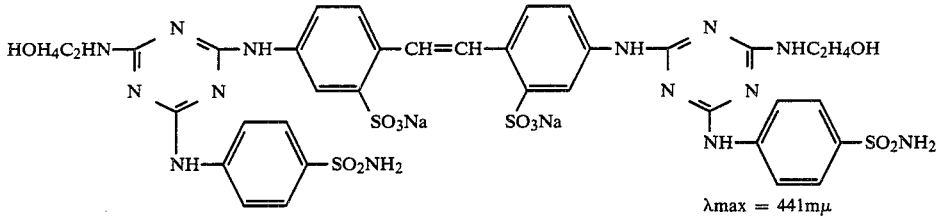
λmax = 441mμ
A-29
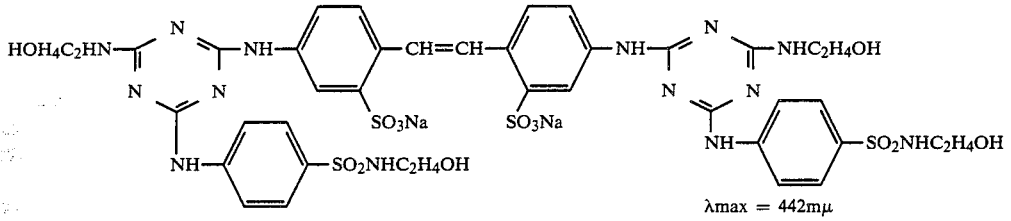
λmax = 442mμ
A-30
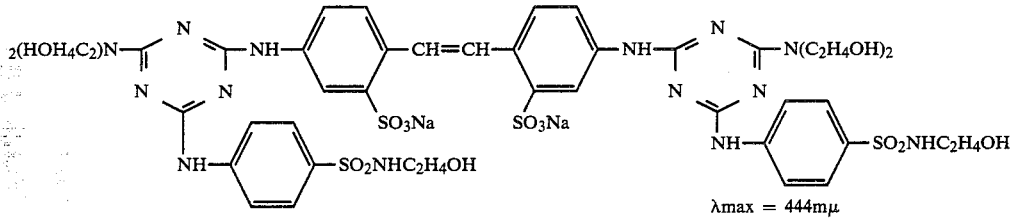
λmax = 444mμ
A-31
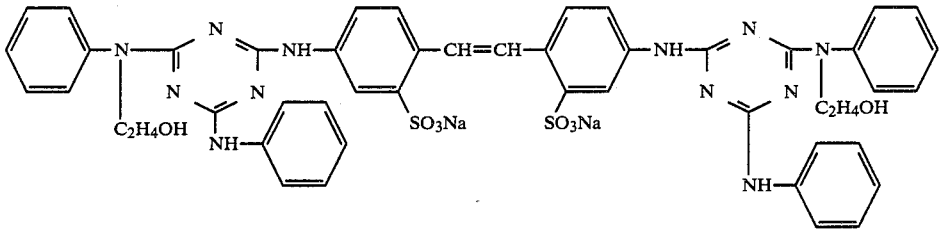
λmax = 443mμ
A-32
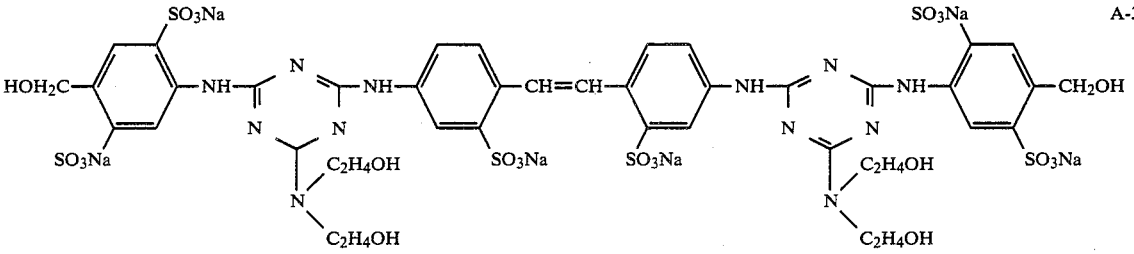
λmax = 443mμ

-continued

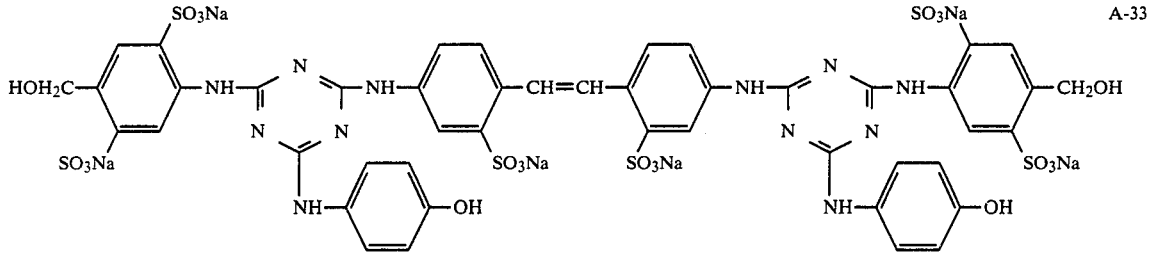

A-33

λmax = 443mμ

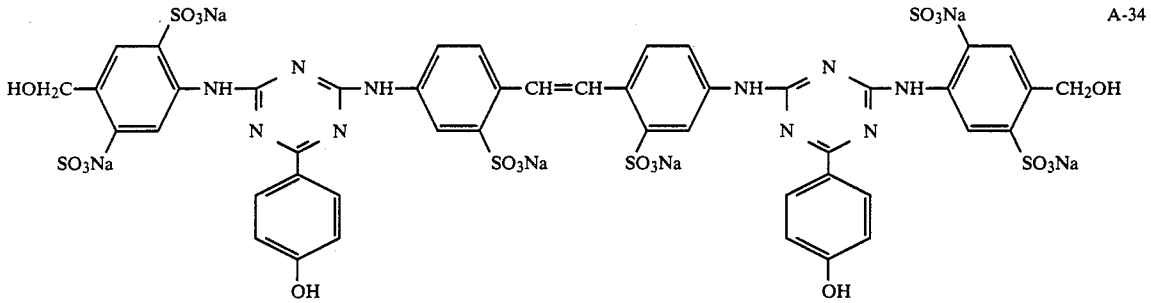

A-34

λmax = 439mμ

The above exemplified triazylstilbene type brightening agents relating to the invention may be synthesized in an ordinary process described in, for example, "Brightening Agents", Society of Synthetic Industry, p. 8, 1976.

There have so far been well known that such a brightening agent as mentioned above has been added to a processing liquid, as described in Japanese Patent Examined Publication Nos. 35240/1971 and 20975/1974, Japanese Patent O.P.I. Publication No. 85232/1973 and the like. Every one of these brightening agents has an object to provide the prevention of ultraviolet rays or to provide the brightening effect on a light-sensitive material. On the other hand, as in the invention, it was discovered that a color stain and particularly, such a stain as caused by a sensitizing dye, an antiirradiation dye and the like can be prevented in the manner that a color developer is added with at least two kinds of triazylstilbene type brightening agents whose difference between the maximum fluorescent wavelengths of their fluorescent spectra is not shorter than 4 mμ. This is a really novel matter of fact.

The sensitizing dyes usable in this invention include those having the following Formula (I) and those having the following Formula (II).

Formula (I)

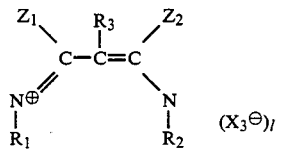

wherein $Z_1$ and $Z_2$ each is a group of atoms necessary to form a benzoxazole, naphthoxazole, benzothiazole, naphthothiazole, benzoselenazole, naphthoselenazole, benzimidazole, naphthoimidazole, pyridine, or quinoline nucleus; $R_1$ and $R_2$ each is a group selected from the class consisting of alkyl, alkenyl, and aryl groups, and is preferably an alkyl group; $R_3$ is a hydrogen atom, methyl or ethyl group; $X_3\ominus$ is an anion; and l is zero or 1.

Formula (II)

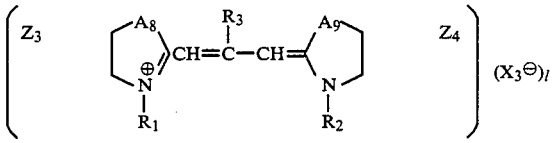

wherein $Z_3$ and $Z_4$ each is a group of atoms necessary to form a benzene or naphthalene ring condensed with an oxazole or thiazole ring. The heterocyclic ring to be formed is allowed to have any of various substituents. The substituent is preferably a halogen atom, an aryl, alkenyl or alkoxy group, more preferably a halogen atom, a phenyl or methoxy group, and most preferably a phenyl group.

The $Z_3$ and $Z_4$ represent preferably benzene rings or thiazole rings condensed with an oxazole ring, and at least one of these benzene rings is substituted in the fifth position thereof with a phenyl group; or one benzene ring is substituted in the fifth position thereof with a phenyl group and the other in the fifth position thereof with a halogen atom. The $R_1$ and the $R_2$ are as defined in the foregoing Formula (I). The $R_1$ and $R_2$ each is preferably an alkyl group substituted with a carboxyl or sulfo group, more preferably a sulfoalkyl group having from 1 to 4 carbon atoms, and most preferably a sulfoethyl group. $A_8$ and $A_9$ each is an oxygen or sulfur atom.

The sensitizing dyes having Formulas (I) and (II) used in this invention may be used also in combination with different other sensitizing dyes; i.e., in the so-called supersensitizing combination. For the incorporation of these sensitizing dyes, different sensitizing dyes are separately dissolved into same or different solvent liquids, and the separately prepared solutions may be either mixed into one and then added to or, without mixing, added separately to an emulsion. If they should be added separately, the adding order and the time interval between the additions may be arbitrarily determined according to the purpose for which they are to be used.

The following are examples of the sensitizing dyes having Formulas (I) and (II), but the sensitizing dyes applicable to this invention are not limited to the following compounds.

I-1

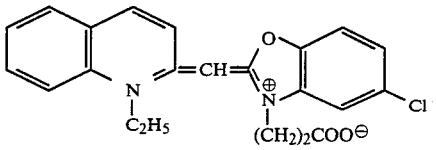

I-2

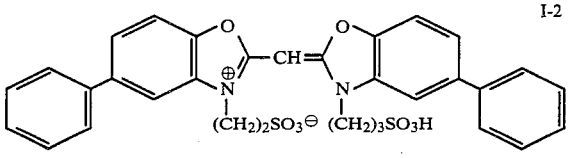

I-3

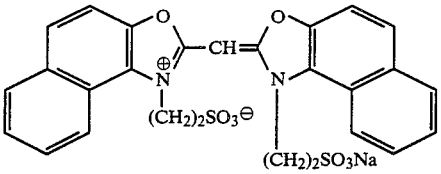

I-4

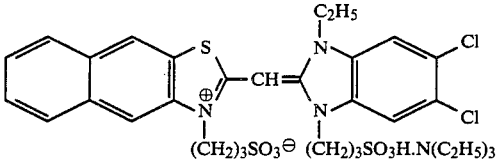

I-5

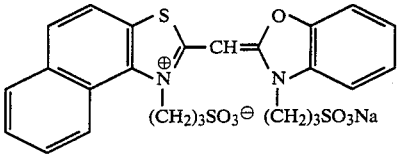

I-6

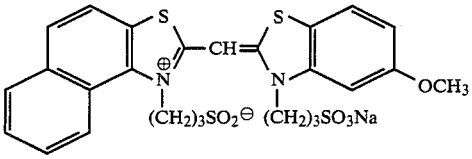

I-7

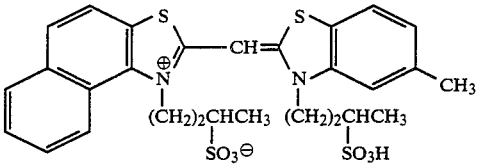

I-8

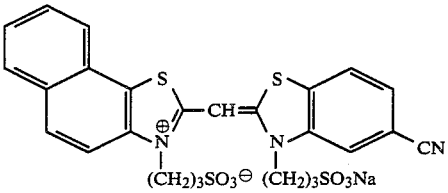

I-9

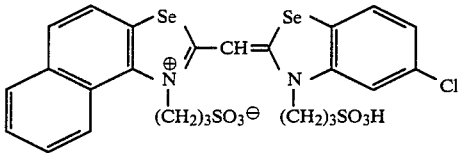

I-10

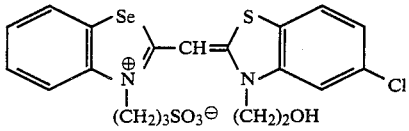

I-11

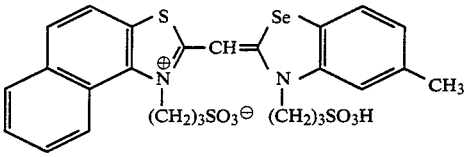

I-12

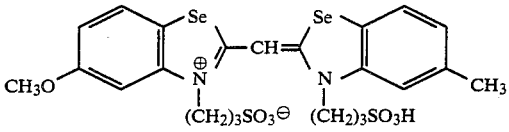

I-13

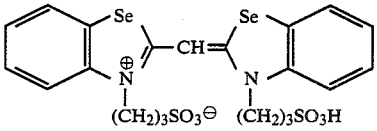

I-14

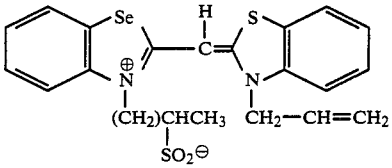

I-15

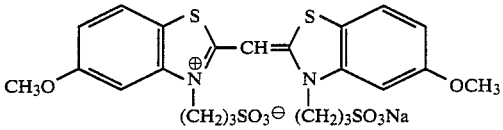

I-16

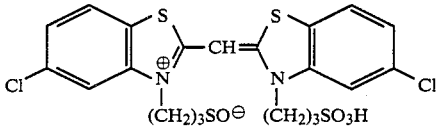

-continued
I-17
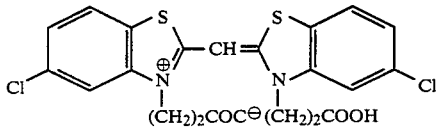
I-18
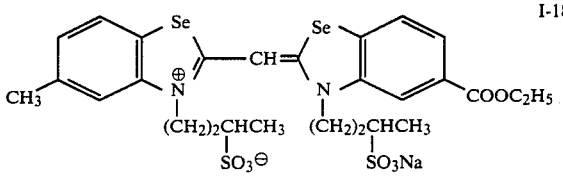
I-19
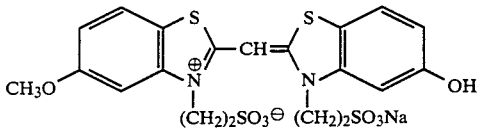
I-20
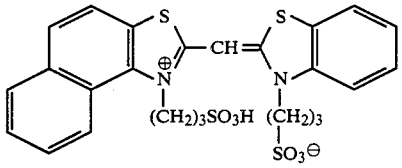
I-21
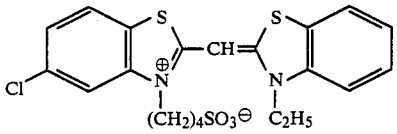
I-22
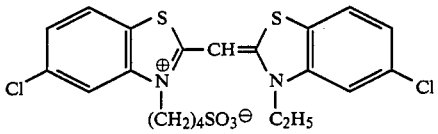
II-1
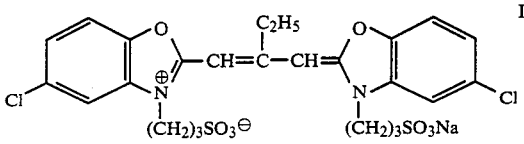
II-2
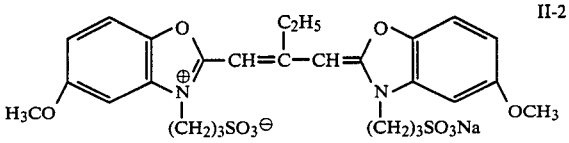
II-3
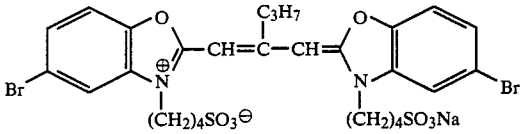
II-4
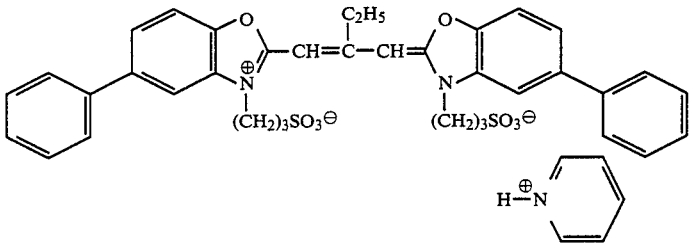
II-5
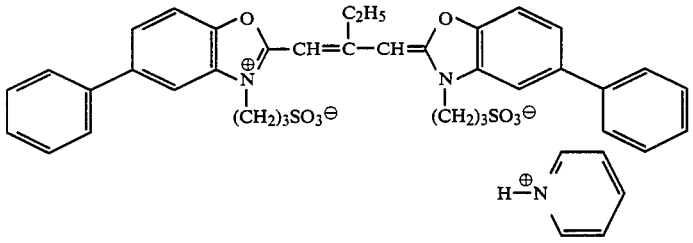
II-6
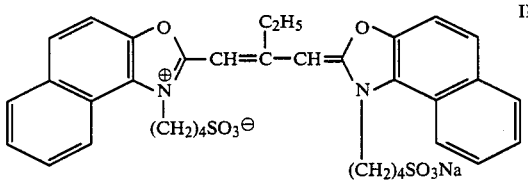
II-7
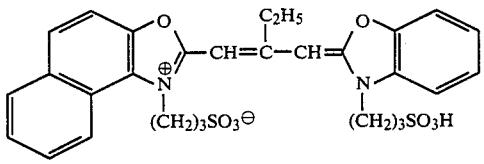

-continued

II-8

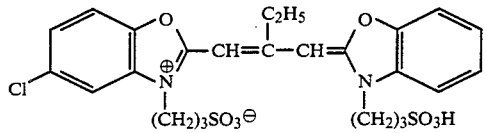

II-9

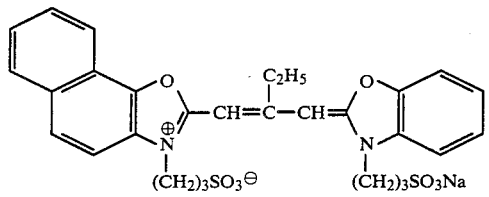

II-10

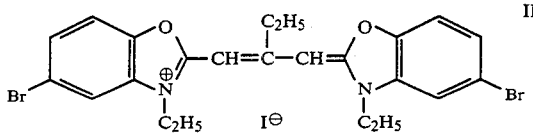

II-11

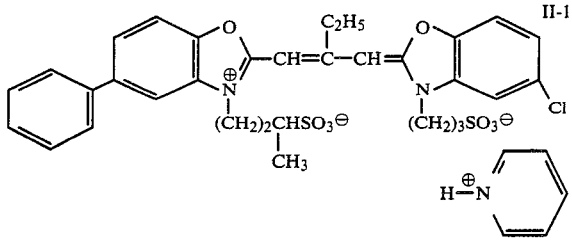

II-12

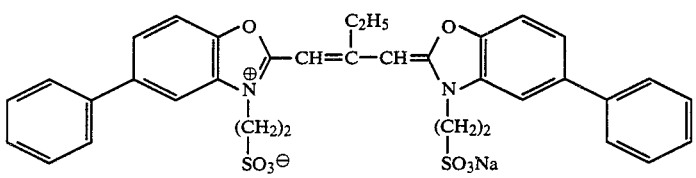

II-13

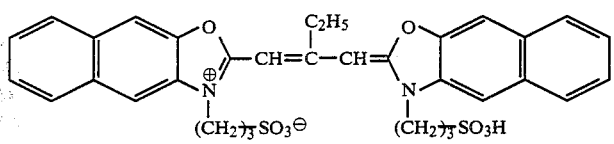

II-14

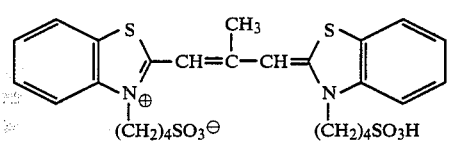

II-15

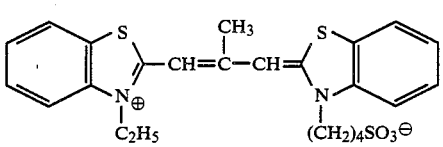

II-16

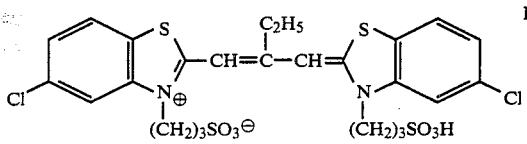

II-17

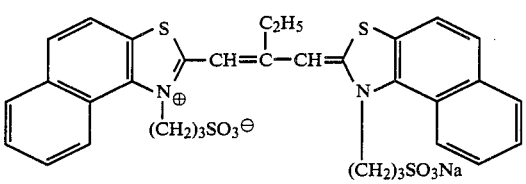

II-18

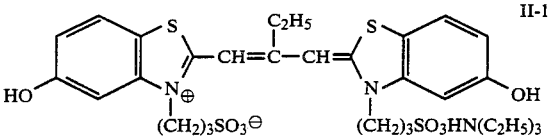

The adding amount of the sensitizing dye of the foregoing Formula (I) or (II) is preferably from $2\times10^{-6}$ to $1\times10^{-3}$ mole per mole of silver halide, and more preferably from $5\times10^{-6}$ to $5\times10^{-4}$ mole.

When, of the sensitizing dyes having Formulas (I) and (II), the sensitizing dye having Formula (I) is used, the effect of this invention is more conspicuously exerted.

The antiirradiation dyes usable in this invention include those compounds having the following Formulas (III) to (VI).

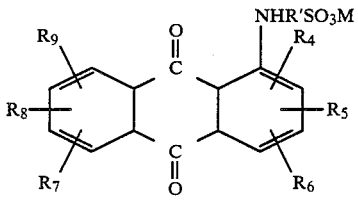

Formula (III)

wherein $R_4$, $R_5$, $R_6$, $R_7$, $R_8$ and $R_9$ each is a hydrogen atom, a halogen atom (such as chlorine, bromine, fluorine), hydroxy group, an alkyl group having from 1 to 4 carbon atoms (such as methyl, ethyl, propyl), an alkoxy group (such as methoxy, ethoxy, propoxy), a $—SO_3M$, or a $—NHR'SO_3M$, wherein R' is an alkylene group (such as methylene, ethylene) and M is a cation of an alkaline metal (such as sodium or potassium), of ammonium, or of an organic ammonium salt (such as pyridinium, piperidinium, triethyl ammonium, triethanolamine, etc.).

The following are typical examples of the compounds having Formula (III), but the present invention is not limited thereto.

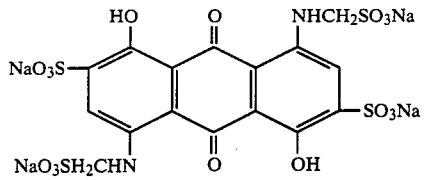

III-1

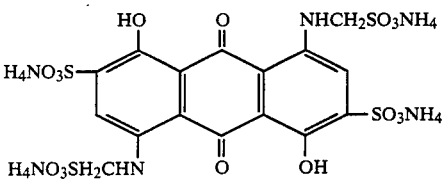

III-2

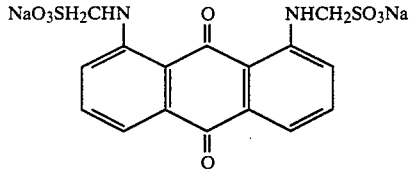

III-3

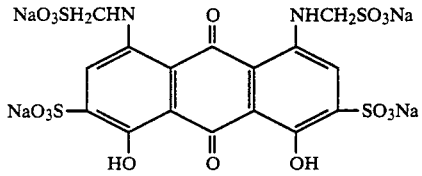

III-4

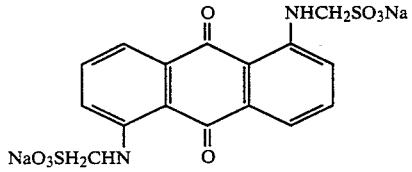

III-5

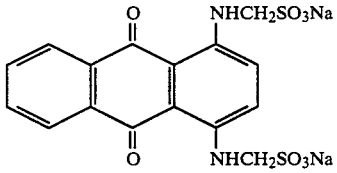

III-6

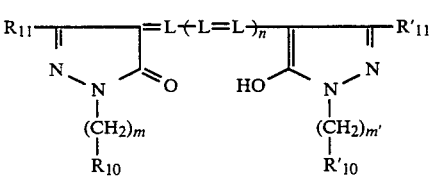

Formula (IV)

wherein $R_{10}$ and $R_{10'}$ each is a hydrogen atom, or an alkyl, aryl or heterocyclic group, which groups each is substitutable, the aryl group including 4-sulfophenyl, 4-(δ-sulfobutyl)phenyl, 3-sulfophenyl, 2,5-disulfophenyl, 3,5-disulfophenyl, 6,8-disulfo-2-naphthyl, 4,8-disulfo-2-naphthyl, 3,5-dicarboxyphenyl, 4-carboxylphenyl, and the like groups. The aryl group is allowed to have a substituent such as a sulfo, sulfoalkyl, carboxy, alkyl (such as methyl, ethyl), halogen (such as chlorine, bromine), alkoxy having from 1 to 4 carbon atoms (such as methoxy, ethoxy), or phenoxy group.

Also, the sulfo group may be combined through a divalent organic group with an aryl group, which includes, for example, 4-(4-sulfophenoxy)phenyl, 4-(2-sulfoethyl)phenyl, 3-(sulfomethylamino)phenyl, 4-(2-sulfoethoxy)phenyl, and the like groups.

Each of the alkyl groups represented by the $R_{10}$ and $R_{10'}$ may be in any of the straight-chain, branched-chain or cyclic form, and have preferably from 1 to 4 carbon atoms, and include, for example, ethyl group, β-sulfoethyl group, and the like.

The heterocyclic group includes, e.g., 2-(6-sulfo)benzothiazolyl group, 2-(6-sulfo)benzoxazolyl) group, and the like, which may have a substituent such as a halogen atom (e.g., fluorine, chlorine, bromine), alkyl (e.g., methyl, ethyl), aryl (e.g., phenyl), carboxyl, sulfo, hydroxy, alkoxy (e.g., methoxy) or aryloxy (e.g., phenoxy) group.

$R_{11}$ and $R_{11'}$ each is a hydroxy group; an alkoxy group having from 1 to 4 carbon atoms (such as methoxy, ethoxy, isopropoxy, n-butoxy); a substituted alkoxy group such as, e.g., an alkoxy group having from 1 to 4 carbon atoms, substituted with a halogen atom or with an alkoxy group having up to 2 carbon atoms (such as β-chloroethoxy, β-methoxy-ethoxy); a cyano group; a trifluoromethyl group; a $—COOR_{12}$ group; a $—CONHR_{12}$ group; a $—NHCOR_{12}$ group (wherein $R_{12}$ is a hydrogen atom, an alkyl group having from 1 to 4 carbon atoms, or an aryl group such as phenyl or naphthyl, the alkyl and the aryl each being allowed to have a sulfo or carboxy group as a substituent); an amino group; a substituted amino group substituted with an alkyl having from 1 to 4 carbon atoms (such as ethylamino, dimethylamino, diethylamino, d-n-butylamino); or a cyclic amino group represented by

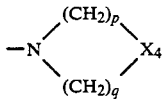

(wherein p and q each is an integer of 1 or 2, and $X_4$ is an oxygen or sulfur atom, or a $CH_2$ group) (such as morpholino, piperidino or piperazino).

L represents a methine group, which is allowed to be substituted with an alkyl group having from 1 to 4 carbon atoms (such as methyl, ethyl, isopropyl, tertiary butyl, etc.) or with an aryl group (such as phenyl, tolyl, etc.).

Also, at least one of the sulfo, sulfoalkyl and carboxy groups of the compound is allowed to form a salt with an alkaline metal (e.g., sodium, potassium), alkaline earth metal (e.g., calcium, magnesium), ammonia, or an organic base (e.g., diethylamine, triethylamine, morpholine, pyridine, piperidine, etc.,). n is an integer of zero, 1 or 2. And, m and m' each is zero or 1.

The following are typical examples of the compounds having the foregoing Formula (IV), but the present invention is not limited thereto.

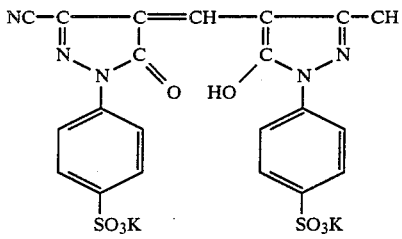
IV-1
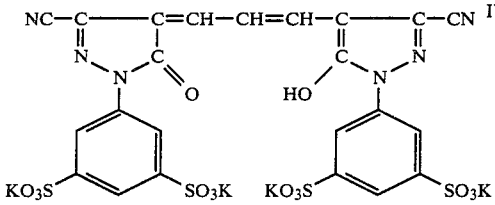
IV-2
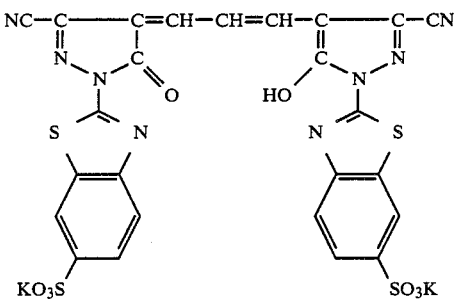
IV-3
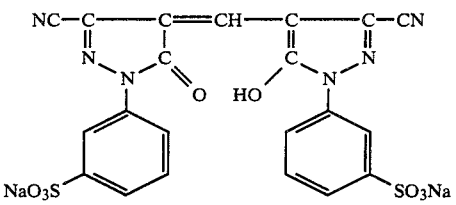
IV-4
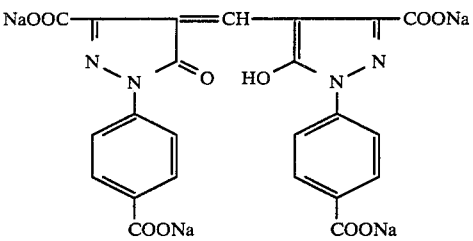
IV-5
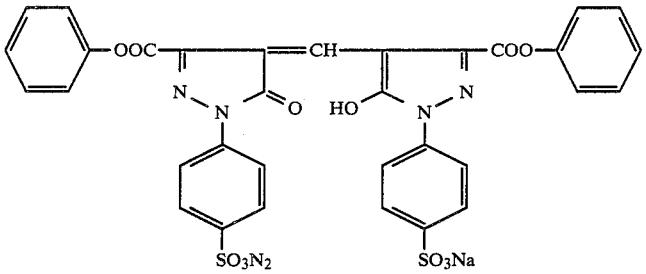
IV-6
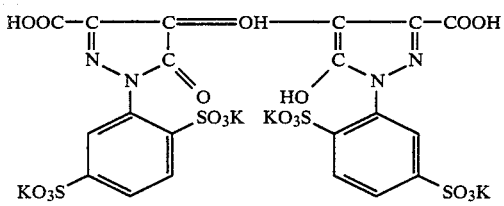
IV-7
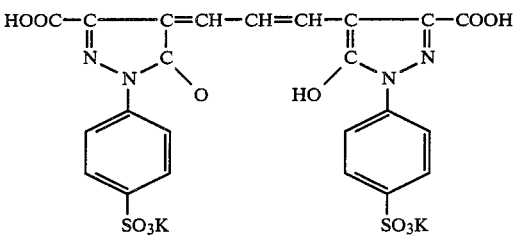
IV-8
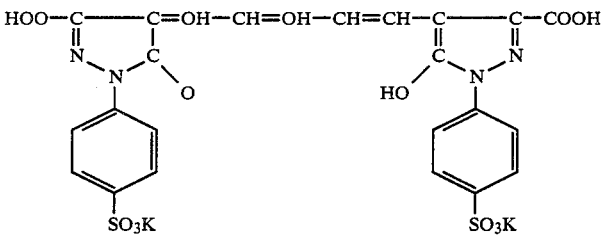
IV-9
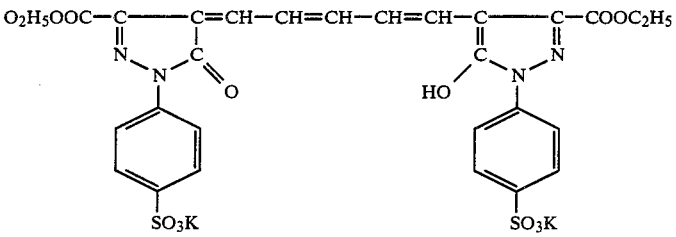
IV-10

-continued
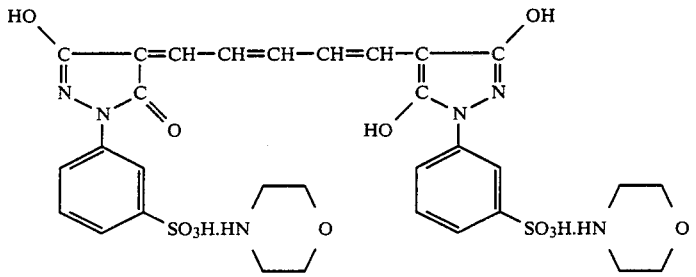
IV-11
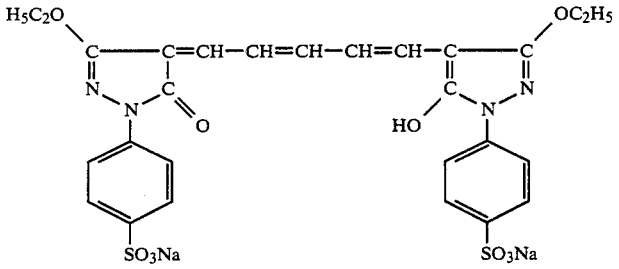
IV-12
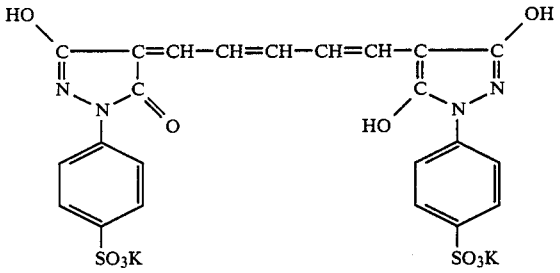
IV-13
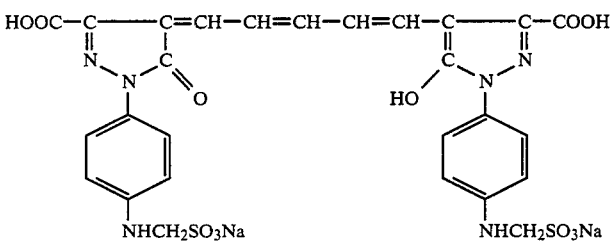
IV-14
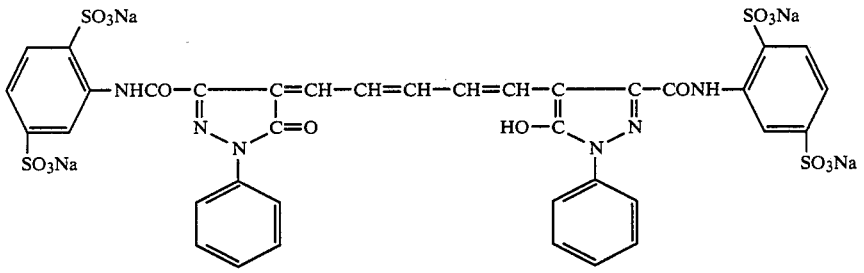
IV-15
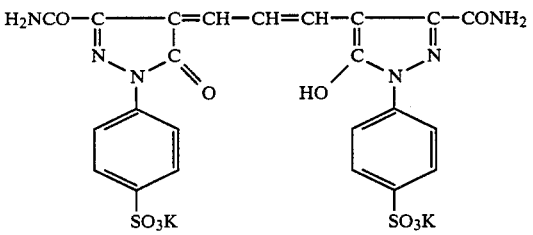
IV-16

-continued
IV-17
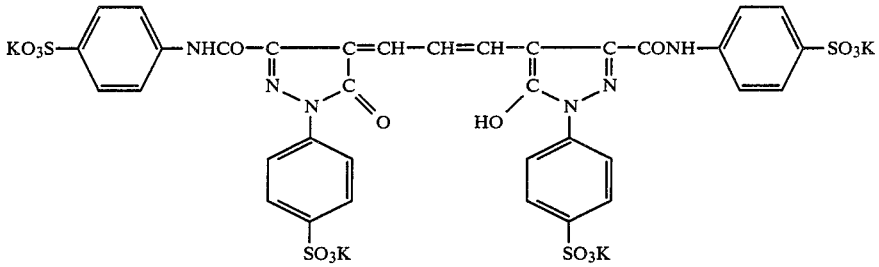
IV-18
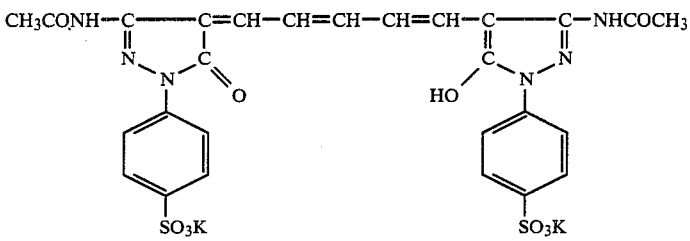
IV-19
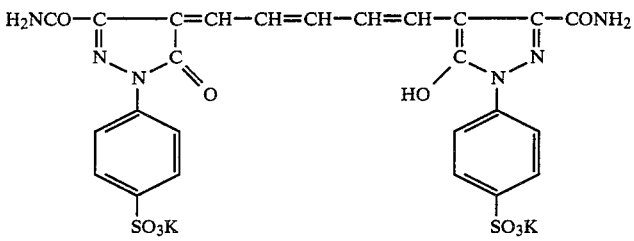
IV-20
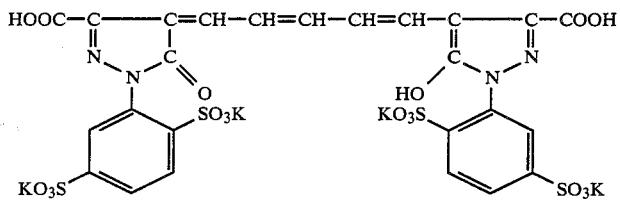
IV-21
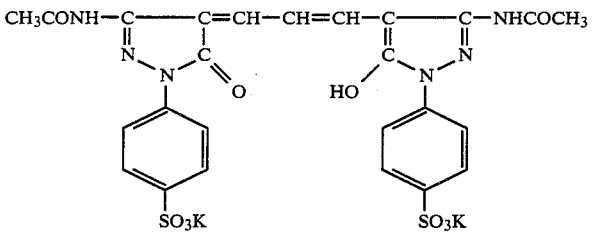
IV-22
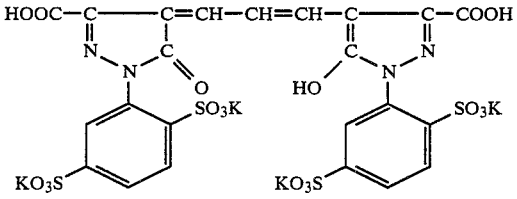
IV-23
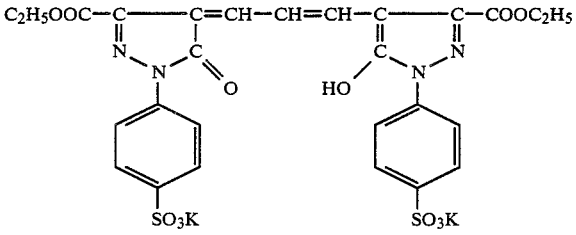

-continued
IV-24
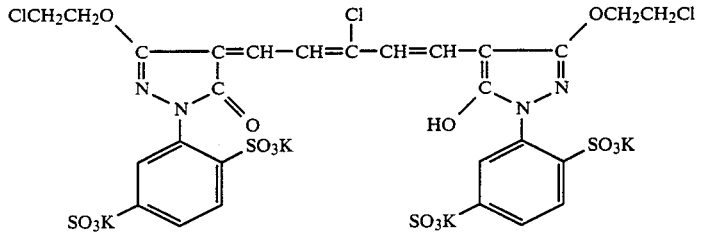
IV-25
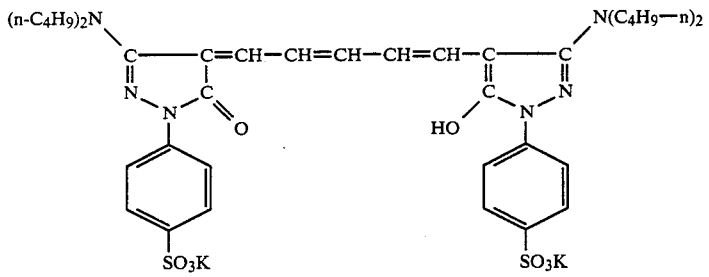
IV-26
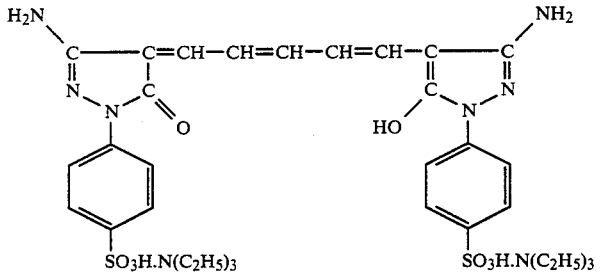
IV-27
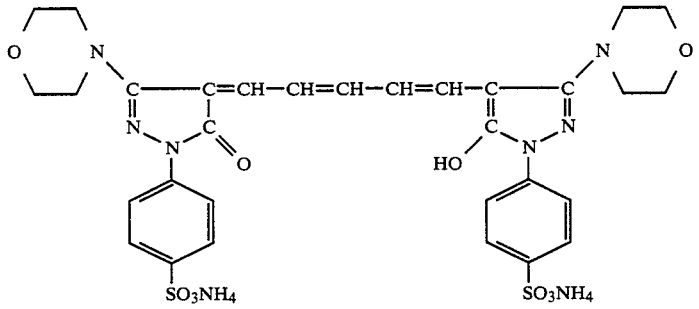
IV-28
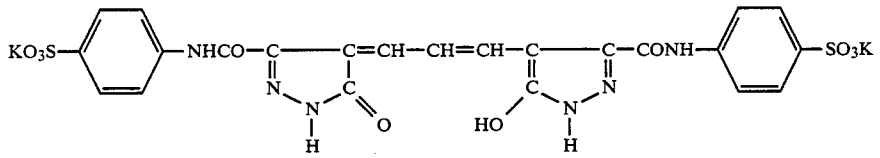
IV-29
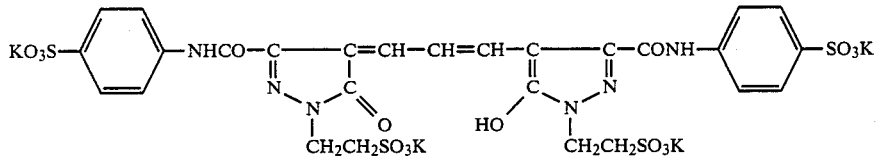

-continued

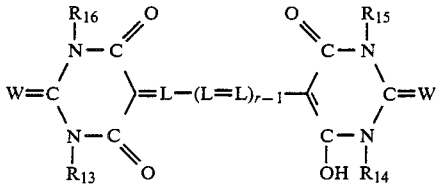

wherein r is an integer of from 1 to 3; W is an oxygen or sulfur atom; L is a methine group; and $R_{13}$, $R_{14}$, $R_{15}$ and $R_{16}$ each is a hydrogen atom, an alkyl, aryl, aralkyl or heterocyclic group, and at least one of the $R_{13}$ through $R_{16}$ is a substituent other than the hydrogen atom.

The methine group represented by the L is as defined in the foregoing Formula (IV).

The alkyl represented by the $R_{13}$ through $R_{16}$ includes the same groups as those defined in the $R_{10}$ and $R_{10'}$ in the foregoing Formula (IV). The alkyl is allowed to have a substituent which includes, e.g., the same various substituents as those to be introduced to the $R_{10}$ and $R_{10'}$ of Formula (IV), and preferably sulfo, carboxy, hydroxy, alkoxy, alkoxycarbonyl, cyano and sulfonyl groups.

The aryl group represented by the $R_{13}$ through $R_{16}$ is desirable to be a phenyl group, the substituent to be introduced to which includes the same various substituents as those to be introduced to the group represented by the $R_{10}$ and $R_{10'}$, and the aryl group is desirable to be one having on its aromatic nucleus at least one of the sulfo, carboxy and sulfamoyl groups.

The aralkyl group represented by the $R_{13}$ through $R_{16}$ is desirable to be a benzyl or phenethyl group, and the substituent to be introduced to the aromatic nucleus includes the same substituents as those for the foregoing aryl represented by the $R_{13}$ through $R_{16}$.

The heterocyclic group represented by the $R_{13}$ through $R_{16}$ includes, e.g., pyridyl, pyrimidyl, and the like, and the substituent to be introduced to the heterocyclic group includes the same substituents as those for the foregoing aryl group represented by the $R_{13}$ through $R_{16}$.

The preferred ones as the group represented by the $R_{13}$ through $R_{16}$ are alkyl and aryl groups, and further desirable to have at least one of the carboxy, sulfo and sulfamoyl groups inside the molecule of the barbituric acid or thiobarbituric acid represented by Formula (V), and the compound is desirable to be of a symmetric structure.

The following are typical examples of the compounds having the foregoing Formula (V), but the present invention is not limited thereto.

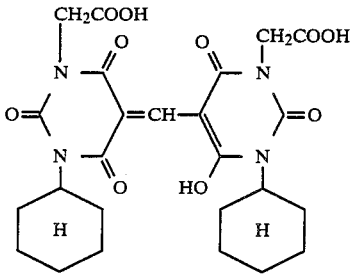

V-1

Formula (V)

-continued

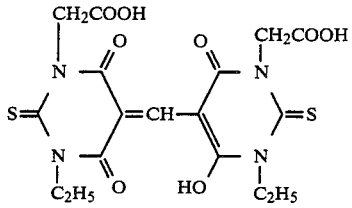

V-2

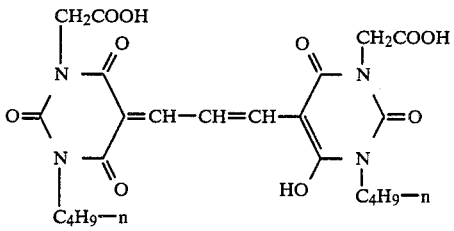

V-3

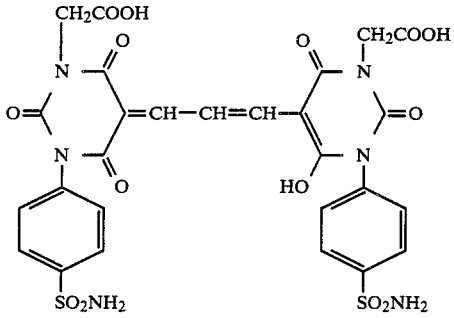

V-4

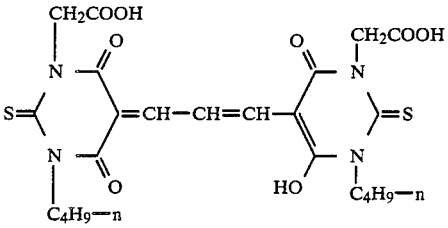

V-5

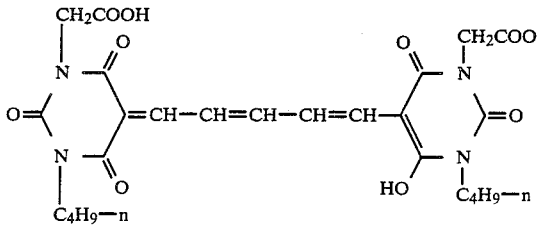

V-6

-continued

V-7

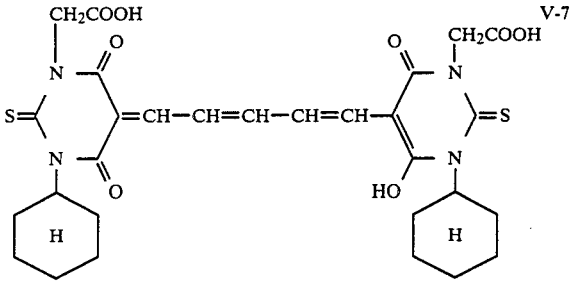

Formula (VI)

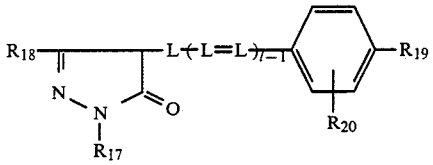

wherein $l_1$ is an integer of 1 or 2; L is a methine group; $R_{17}$ is as defined in the $R_{10}$ and $R_{10'}$ in Formula (IV), and preferably an alkyl or aryl group, the aryl group being desirable to have at least one sulfo group; $R_{18}$ is alkyl group and as defined in the $R_{11}$ and $R_{11'}$ of Formula (IV) and represents preferably one selected from the class consisting of alkyl, carboxy, alkoxycarbonyl, carbamoyl, ureido, acylamino, imido and cyano groups; $R_{19}$ represents a $-OZ_5$ or

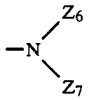

group, wherein $Z_5$, $Z_6$ and $Z_7$ each is a hydrogen atom or an alkyl group, provided the $Z_6$ and $Z_7$ are allowed to be the same as or different from each other and also allowed to combine with each other to form a cyclic ring, the alkyl group represented by the $Z_5$, $Z_6$ and $Z_7$ including, e.g., methyl, ethyl, butyl, hydroxyalkyl (e.g., hydroxyethyl), alkoxyalkyl (e.g., β-ethoxyethyl), carboxyalkyl (e.g., β-carboxyethyl), alkoxycarbonylalkyl (e.g., β-ethoxycarbonylethyl), cyanoalkyl (e.g., β-cyanoethyl) and sulfoalkyl (e.g., β-sulfoethyl, γ-sulfopropyl) groups, the $Z_6$ and the $Z_7$ being allowed to combine with each other to form a 5- or 6-member cyclic ring such as of morpholino, pyperidino, pyrolidino, or the like group; and $R_{20}$ is a hydrogen atom, an alkyl group, a chlorine atom, or an alkoxy group, the alkyl including, e.g., methyl, ethyl, and the like, the alkoxy group including, e.g., methoxy, ethoxy, and the like.

The following are typical examples of the compounds having the foregoing Formula (VI), but the present invention is not limited thereto.

VI-1

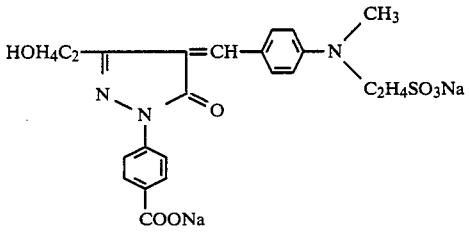

-continued

VI-2

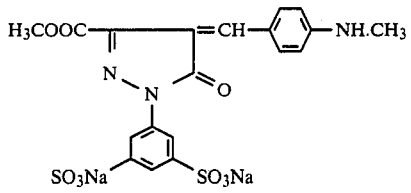

VI-3

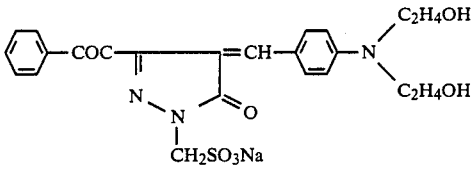

VI-4

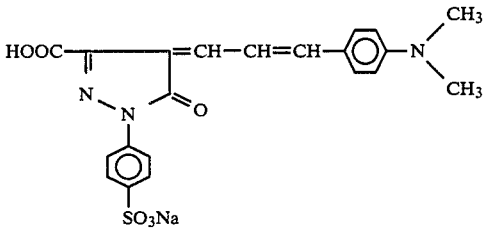

VI-5

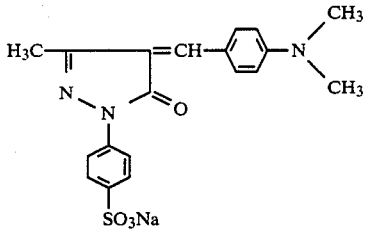

VI-6

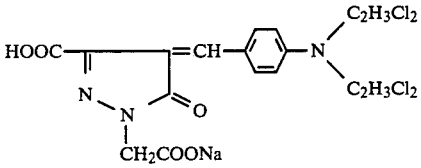

VI-7

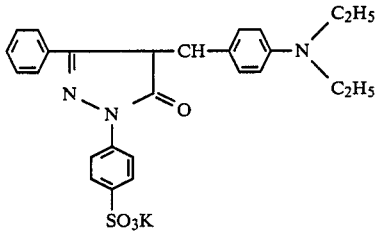

VI-8

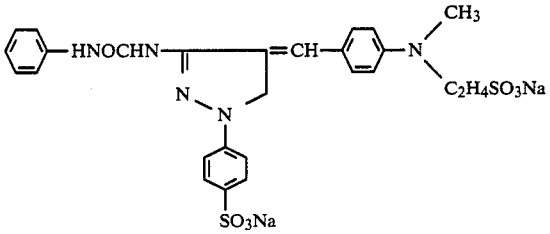

These compounds of the above Formulas (III), (IV), (V) and (VI) may be synthesized by the synthesis methods described in U.S. Pat. Nos. 3,575,704, 3,247,127, 3,540,887 and 3,653,905, and Japanese Patent O.P.I.

Publication Nos. 85130/1973, 99620/1974, 111640/1984, 111641/1984 and 170838/1984.

For the incorporation of any of the compounds of Formulas (III), (IV), (V) and (VI) into a light-sensitive material, the compound may be incorporated into any of silver halide emulsion layers or other hydrophilic colloidal layers in the manner that an appropriate organic or inorganic salt of the compound of this invention is dissolved into water to prepare an appropriate concentration having aqueous dye solution, which is added to a coating liquid, and the liquid is then coated in a procedure of the prior art, thereby incorporating the compound into the light-sensitive material.

The invention's compound content of the light-sensitive material should be 1 to 800 mg, and preferably 2 to 200 mg per $m^2$ of the light-sensitive material.

Of these compounds represented by Formulas (III), (IV), (V) and (VI), the ones having Formula (IV) are best suitable. These compounds may be used in combination with each other.

The objects of the invention cannot be achieved by adding only one kind of the triazylstilbene type brightening agents relating to the invention but can be achieved by using two or more kinds thereof each having the difference of the maximum fluorescent wavelengths between them is 4 mμ or longer. The objects of the invention can preferably be achieved and excellent and stainless images can be obtained when the triazylstilbene type brightening agents are used in combination in which the maximum fluorescent wavelengths λmax thereof are 433 to 438 mμ and 439 to 443 mμ, respectively and the difference of the maximum fluorescent wavelengths between them is 4 mμ or longer.

Triazylstilbene type brightening agents are used for the invention by being added in a processing liquid, however the objects of the invention cannot be achieved if the aggregate amount thereof added is not more than 0.3 g per liter of a color developing solution. If not less than 10 g, there causes an inhibition of developability, a fluorescent quenching, or an unfavorable photographic performance such as non-color-recurring. In the invention, therefore, triazylstilbene brightening agent is contained in the aggregate amount of 0.3 g to 10 g and more preferably 0.5 g to 5 g per liter of a processing liquid.

As described above, there are used in combination at least two kinds of triazylstilbene type brightening agents having the difference of the λmax of the fluorescent spectra thereof is not shorter than 4 mμ from each other brightening agent. The amounts of triazylstilbene type brightening agent of which λmax is a long wavelength and that of which λmax is a short wavelength to be added is preferably in the proportion 1:5 to 5:1 and more preferably 1:3 to 2:1.

How to add the triazylstilbene type brightening agents is that they are altogether or independently contained, in the form of powders or an aqueous solution thereof, into the compositions of a prepared processing chemicals.

It is also obtainable a good result when they are added in the form of powders or an aqueous solution at the time of preparing the processing liquid or after preparing it.

How to obtain the respective maximum fluorescent wavelengths of triazylstilbene type brightening agents to be used in the invention is made according to the method described in "Dyes and Chemicals" vol. 8, No. 5, p. 22, 1963.

The color developing agents to be used in the color developers relating to the invention are aromatic primary amine compounds and particularly preferable ones are color developing agents of a p-phenylenediamine type, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxy ethylaniline, 3-β-methanesulfonamideethyl-4-amino-N,N-diethylaniline, 3-methoxy-4-amino-N-ethyl-N-β-hydroxyethylaniline, 3-methoxy-4-amino-N-ethyl-N-β-methoxy ethylaniline, 3-acetamide-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, and the salts thereof such as a sulfate, a chloride, a sulfite, p-toluene sulfonate, and the like.

These color developing agents are to be used, in general, in the concentration of about 1 g to about 15 g thereof per liter of a color developer used.

The abovementioned color developing agents may be used independently or in combination with two kinds thereof, and further may also be used together with a black-and-white developing agent such as hydroquinone if occasion demands.

The color developers relating to the invention may contain, besides the abovementioned color developing agents, an alkaline substance being ordinarily used, such as sodium hydroxide, potassium hydroxide, ammonium hydroxide, sodium carbonate, potassium carbonate, sodium sulfate, sodium metaborate, silica sand, and the like; and further there may also contain a variety of additives, for example, benzyl alcohol; a halogenated alkali metal such as potassium bromide; a development adjuster such as citradinic acid; a preservative such as sulfurous acid; a chelating agent such as a phosphate (e.g., a polyphosphate), an amino polycarboxylic acid (e.g., nitrilotriacetic acid and 1,3-diamino-2-propanotetraacetic acid), an oxycarboxylic acid (e.g., citric acid and gluconic acid), 1-hydroxyethylidene-1,1-diphosphonic acid, aminotrimethylene phosphonic acid, and the like. The pH values of the color developers are about 9 to 13, normally. This type of color developing processes by making use of the abovementioned color developers include such a process that a black-and-white development and a color development are used in combination as in a color reversal process.

A variety of bleaching agents may be used in the bleach-fix baths to be used in the invention. For example, metallic complex salts of an organic acid have the function of oxidizing metal silver produced in a developing process to change into a silver halide and at the same time the metallic complex salts have the function of developing the undeveloped color areas of a coloring agent. The structure thereof is that metal ions of iron, cobalt, copper or the like are coordinated with such an organic acid as aminocarboxylic acid, oxalic acid or citric acid. As for the examples of the most preferable organic acids capable of being used for preparing the metal complex salts of the abovementioned organic acids, aminopolycarboxylic acids having the following Formula [B] or [C]:

$$HOCO-A_1-Z-A_2-COOH \qquad \text{Formula [B]}$$

-continued

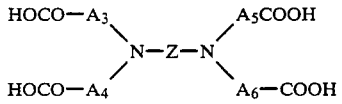

Formula [C]

Wherein, $A_1$, $A_2$, $A_3$, $A_4$, $A_5$ and $A_6$ represent a substituted or non-substituted hydrocarbon group, respectively; and Z represents a hydrocarbon group, oxygen, sulfur or $>N—A_7$ wherein $A_7$ represents a hydrocarbon group or an aliphatic carboxylic acid.

These aminopolycarboxylic acids may be an alkaline metal salt, an ammonium salt or a water-soluble amine salt. The following compounds may be given as the typical examples of aminopolycarboxylic acids having the aforementioned Formula [B] or [C], and the other types of aminopolycarboxylic acids:

[Exemplified compounds]

(B-1) Ethylenediaminetetraacetic acid
(B-2) Diethylenetriaminepentaacetic acid
(B-3) Ethylenediamine-N-(β-oxyethyl)-N,N',N'-triacetic acid
(B-4) Propylenediaminetetraacetic acid
(B-5) Nitrilotriacetic acid
(B-6) Cyclohexanediaminetetraacetic acid
(B-7) Iminodiacetic acid
(B-8) Dihydroxyethylglycine
(B-9) Ethyletherdiaminetetraacetic acid
(B-10) Glycoletherdiaminetetraacetic acid
(B-11) Ethylenediaminetetrapropionic acid
(B-12) Phenylenediaminetetraacetic acid
(B-13) Disodium ethylenediaminetetraacetate
(B-14) Tetra(or Tri)methylammonium ethylenediaminetetraacetate
(B-15) Tetrasodium ethylenediaminetetraacetate
(B-16) Pentasodium diethylenetriamine pentaacetate
(B-17) Sodium ethylenediamine-N-(β-oxyethyl)-N,N',N'-triacetate
(B-18) Sodium propylenediaminetetraacetate As for the bleach-fix baths to be used in the invention, there are applied a liquid comprising a bleaching agent being contained therein such as metal complex salt, e.g., an iron complex salt, of an organic acid as described above and a silver halide fixer being contained therein such as a thiosulfate, a thiocyanate, a thiourea and the like. Besides the bleaching agents and the silver halide fixers, there may also be used a bleach-fix bath comprising a small amount of such a halogen compound as potassium bromide added thereto, another type of the bleach-fix baths comprising contrarily a large amount of such a halogen compound as potassium bromide added thereto, or a further special type thereof comprising the combination of a bleaching agent and such a large amount of a halogen compound as potassium bromide. As for the abovementioned halogen compounds, there may also be used, besides potassium bromide, hydrochloric acid, hydrobromic acid, lithium bromide, sodium bromide, ammonium bromide, potassium iodide, ammonium iodide and the like.

As for the silver halide fixers to be contained in the bleach-fix baths, there is used a compound capable of forming a water-soluble complex salt in a process of reacting with such a silver halide as is used in an ordinary fixing process. The typical examples thereof are a thiosulfate such as potassium thiosulfate, sodium thiosulfate and ammonium thiosulfate, a thiocyanate such as potassium thiocyanate, sodium thiocyanate and ammonium thiocyanate, thiourea, thioether, a highly concentrated bromide and a highly concentrated iodide.

On the other hand, the abovementioned bleach-fix baths may contain, independently or in combination, pH buffers comprising a variety of salts such as a borate, a borax salt, sodium hydroxide, potassium hydroxide, sodium carbonate, potassium carbonate, sodium hydrogencarbonate, potassium hydrogencarbonate, an acetate, sodium acetate and ammonium hydroxide. Further, a variety of defoaming agents or surface active agents may also be contained therein. Still further, there may be contained appropriately such a preservative as a bisulfite addition product of a hydroxylamine, hydrazine or aldehyde compound, such an organic chelating agent as aminopolycarboxylic acid, some kind of stabilizers such as nitroalcohol nitrate, or an organic solvent such as methanol, dimethyl-formaldehyde, and dimethylsulfoxide, and the like.

It is not always necessary to process such development and bleach-fixing in succession, but the other processes such as hardening, stopping, washing, stabilizing and the like may be performed before each of the abovementioned process or thereafter.

Silver halide color photographic light-sensitive materials to which a bleach-fix bath for color photographic use relating to the invention is applied are those each having a support such as a sheet of paper, synthetic resin film e.g., an ordinary film as cellulose acetate film and polyethylene terephthalate film, glass plates and the like, that being coated thereon with at least one of silver halide emulsion layers in a dipping or an air-knife method. Such emulsion layers are prepared in a process that a light-sensitive silver halide such as silver chloride and silver iodobromide is dispersed in a generally known hydrophilic colloid such as protein e.g., gelatin, colloidal albumin, casein and the like, a cellulose derivative, polysaccharide, a hydrophilic synthetic colloid and the like. These silver halide emulsions are prepared in an ordinary process in which a water-soluble silver salt and a water-soluble halogenated substance are mixed in the presence of water and a hydrophilic colloid and the mixture thereof is then chemically ripened. In these emulsions, such an additive for photographic use as a sensitizing dye, a stabilizer, a hardening agent, a coating assistant and the like may be added in the preparation process or immediately thereafter. This type of emulsions ordinarily comprise three color-sensitive layers, i.e., a blue-sensitive emulsion layer, a green-sensitive layer, and a red-sensitive layer, and each of which may further be separated into two or more layers if occasion demands. Still further each of the light-sensitive emulsion layers may be contained with such an ordinary type coupler as described in Japanese Patent Examined Publication Nos. 22514/1971 and 7344/1978, and the like.

The invention can be applied to the processes of the common types of silver halide color photographic light-sensitive materials such as color negative films, color papers, color positive films, color reversal films for slide use, cinematographic color reversal films, color films for television use, color reversal papers and the like.

The invention will be detailedly described hereafter with reference to the examples, however, it is to be understood that the embodiments of the invention shall not be limited thereto.

EXAMPLE 1

Silver halide color photographic light-sensitive material was prepared by coating each of the following layers on the support made of polyethylene coated paper respectively in the order from the support:

1st layer

This layer was a blue-sensitive silver halide emulsion layer comprising a silver chlorobromide emulsion containing 95 mole% of silver bromide, and in which the emulsion contained 350 g of gelatin per mole of silver halide and was sensitized by making use of a sensitizing dye having the following structure in the amount of $2.5\times10^{-4}$ mole per mole of silver halide, (and whereto isopropyl alcohol was used as the solvent);

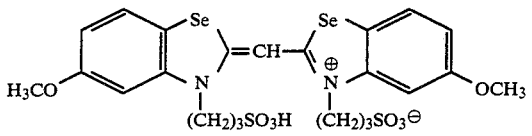

and the emulsion also contained 2,5-di-t-butyl hydroquinone which was dissolved and dispersed in dibutyl phthalate, and α-[4-(1-benzyl-2-phenyl-3,5-dioxo-1,2,4-triazolidyl)]-α-pivalyl-2-chloro-5-[γ-(2,4-di-t-amylphenoxy)butylamide]acetanilido, a yellow coupler, in the amount of $2\times10^{-1}$ mole per mole of silver halide. This emulsion was coated so that the amount of silver thereof could be 350 mg/m$^2$.

2nd layer

This layer was a gelatin layer containing 300 mg/m$^2$ g of di-t-octylhydroquinone which was dissolved and dispersed in dibutyl phthalate and 200 mg/m$^2$ of an ultraviolet absorbing agent, i.e., the mixture of 2-(2'-hydroxy-3',5'-di-t-butyl phenyl)benzotriazole, 2-(2'-hydroxy-5'-t-butyl phenyl)benzotriazole, 2-(2'-hydroxy-3'-t-butyl-5'-methyl phenyl)-5-chlorbenzotriazole, and 2-(2'-hydroxy-3',5'-di-t-butyl phenyl)-5-chlor-benzotriazole. This gelatin layer was coated so that the amount of gelatin could be 2000 mg/m$^2$.

3rd layer

This layer was a green-sensitive silver halide emulsion layer comprising a silver chlorobromide emulsion containing 85 mole% of silver bromide. The emulsion contained 450 g of gelatin per mole of silver halide and was sensitized by a sensitizing dye having the following structure in the amount of $2.5\times10^{-4}$ mole per mole of silver halide;

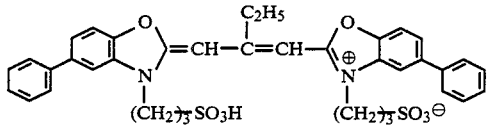

and the emulsion also contained 2,5-di-t-butylhydroquinone which was dissolved and dispersed in the solvent comprising dibutyl phthalate and tricresyl phosphate in 2:1 proportion, and 1-(2,4,6-trichlorophenyl)-3-(2-chloro-5-octadecenyl succinimide anilino)-5-pyrazolone, a magenta coupler, in the amount of $1.5\times10^{-1}$ mole per mole of silver halide. This emulsion layer was coated so that the amount of silver coated could be 400 mg/m$^2$ and 2,2,4-trimethyl-6-lauryloxy-7-t-octylchroman was used in the amount of 0.5 mole per mole of the couplers, to serve as an antioxidant.

4th layer

This layer was a gelatin layer containing 30 mg/m$^2$ of di-t-octyl hydroquinone which was dissolved and dispersed in dibutyl phthalate and 500 mg/m$^2$ of an ultraviolet absorbing agent, i.e., the mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorbenzotriazole, and 2-(2'-hydroxy-3',5'-t-butylphenyl)-5-chlorbenzotriazole in the respective proportion of 2:1.5:1.5:2. This gelatin layer was coated so that the amount of gelatin coated could be 2000 mg/m$^2$.

5th layer

This layer was a red-sensitive silver halide emulsion layer comprising a silver chlorobromide emulsion containing 85 mole% of silver bromide. The emulsion thereof contained gelatin in the amount of 500 g per mole of the silver halide and was sensitized by making use of a sensitizing dye having the following structure in the amount of $2.5\times10^{-4}$ mole per mole of the silver halide;

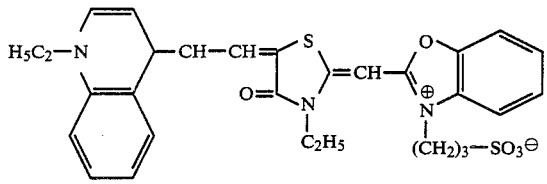

and the emulsion also contained 2,5-di-t-butyl hydroquinone which was dissolved and dispersed in butyl phthalate and 2,4-dichloro-3-methyl-6-[γ-(2,4-diamylphenoxy)butylamide]phenol, a cyan coupler, in the amount of $3.5\times10^{-1}$ mole per mole of the silver halide. This emulsion was coated so that the amount of silver could be 270 mg/m$^2$.

6th layer

This layer was a gelatin-made protective layer which was coated so that the amount of the gelatin could be 1000 mg/m$^2$.

Each of the silver halide emulsions used in the respective 1st, 3rd and 5th light-sensitive layers was prepared in the method described in Japanese Patent Examined Publication No. 7772/1971, and which was chemically sensitized by making use of sodium thiosulfate pentahydrate and was then contained respectively with 4-hydroxy-6-methyl-1,3,3a,7-tetrazaindene as a stabilizer, bis(vinylsulfonylmethyl)ether as a hardener, and saponin as a coating assistant.

Samples prepared in the abovementioned method were exposed to light by means of a SAKURA Color Printer, mfd. by Konishiroku Photo Ind. Co., Ltd., Japan, an automatic printer, and were processed by means of a Color Roll Processor, Model RP-1180 SRC, mfd. by Noritsu Koki Co., Ltd., Japan, an automatic processor, by which the samples were applied to the respective 100 hour running processes, and then the color dye stains thereon were observed.

| Processing steps taken by an automatic processor | Processing temperature (°C.) | Processing time (min.) |
|---|---|---|
| 1. Color developing | 33 ± 0.3 | 3.5 |
| 2. Bleach-fixing | 30–34 | 1.5 |
| 3. Washing | 30–34 | 3.5 |
| 4. Drying | 75–85 | — |

Among the above steps, each of the developing process and the bleach-fixing process was continuously replenished by a color developing replenisher and a regenerated bleach-fixing replenisher respectively at the rate of 325 ml each when every 1 $m^2$ of the samples was processed.

The color developing replenisher and the color developer used therein were as follows:

Color developing replenisher . . . The following four kinds of the compositions [1], [2], [3] and [4] were added to, mixed with and then dissolved one after another in an appropriate amount of pure water to make one liter for example, and thereby one liter of a color developing replenisher for color-paper use was thus prepared. The amount thereof necessary for processing samples was prepared appropriately to use.

| | |
|---|---|
| Composition [1] | |
| Benzyl alcohol | 20 ml |
| Ethylene glycol | 20 ml |
| Additive (I), i.e., a triazylstilbene type brightening agent of the invention | 2.0 g |
| Additive (II), i.e., a triazylstilbene type brightening agent of the invention | 2.0 g |
| Add water to make | 50 ml |
| Composition [2] | |
| Hydroxylamine sulfate | 4 g |
| Composition [3] | |
| 3-methyl-4-amino-N—ethyl-N—(β-methanesulfonamideethyl) aniline sulfate | 7 g |
| Composition [4] | |
| Potassium carbonate | 30 g |
| 1-hydroxyethylidene-1,1-diphosphonic acid (60% solution) | 1.1 ml |
| Potassium sulfite (50% solution) | 5 ml |
| Potassium hydroxide | 3 g |
| Add water to make | 50 ml |

The pH value of this replenisher may sometimes be lowered according to an additive added thereto, and the pH value thereof was adjusted to pH 10.45 by suitably adding potassium hydroxide when adding water to make one liter thereof. Color developer . . . The above-mentioned color developing replenisher of 800 ml were added by the following color developing starter and were then added by water to make one liter, and thus one liter of color developer of the pH 10.20 was prepared. The amount thereof necessary for processing the samples was prepared to use.

| Color developing starter | |
|---|---|
| Potassium carbonate | 2.2 g |
| Potassium hydrogencarbonate | 3.4 g |
| Potassium bromide | 0.64 g |
| Potassium chloride | 0.50 g |

The bleach-fixing solution and the regenerated bleach-fixing solution used therein were as follows:

| Bleach fixing solution | |
|---|---|
| Composition [5] | |
| Ethylenediamine tetraacetic acid | 40 g |
| Ammonium sulfite (50% solution) | 30 ml |
| Ammonium thiosulfate (70% solution) | 140 ml |
| Aqueous ammonia (28% solution) | 30 ml |
| Add water to make | 250 ml |
| Composition [6] | |
| Iron(III)sodium ethylenediamine tetraacetate | 70 g |

The bleach-fixing solution was prepared in the manner that the abovementioned Compositions [5] and [6] were dissolved so that the pH value may be adjusted by using aqueous ammonia and acetic acid to pH 7.10 and the total amount thereof may be one liter by adding water thereto.

As for the bleach-fix replenisher, the abovementioned bleach-fix solution was used in the running process and the start, and thereafter the regenerated bleach-fix replenisher was used.

| Regenerated bleach-fix solution | |
|---|---|
| Ethylenediamine tetraacetic acid | 250 g |
| Ammonium sulfite (50% solution) | 140 ml |
| Ammonium thiosulfate (70% solution) | 350 ml |
| Aqueous ammonia (28% solution) | 95 ml |
| Add water to make | 1 liter |

Silver was recovered from one liter of the used bleach-fix solution over-flown from an automatic processor by means of a SAKURA Repro-Unit Model I, mfd. by Konishiroku Photo Ind. Co., Ltd., Japan, and 150 ml of the solution were disused and the remaining 850 ml thereof were appropriately aerated. Then, the regenerated bleach-fix solution in the amount of 150 ml per 850 ml of the above remaining solution were added to prepare a regenerated bleach-fix replenisher that was used therein.

After operating as mentioned above, the running process was applied for 100 hours, however, as the experiments for the control purpose, the running process without adding Additive (I) and/or Additive (II) thereto was also tried. Further the running processes were performed in which the undermentioned brightening agents other than those of the invention were used for the control purpose;

Brightening agent for control use (a-1)

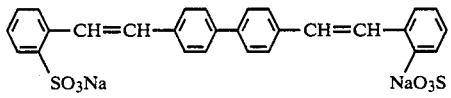

λmax = 430 mμ

Brightening agent for control use (a-2)

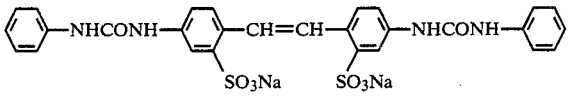

λmax = 435 mμ

After the respective 100 hour running processes, each of the spectral reflectivity with respect to the color dye stains was measured in 450 mμ and 510 mμ by means of a Hitachi Spectrophotograph Model EPS-3T.

The results thereof are shown in Table 1.

TABLE 1

| Sample No. | Additive (I) (λmax) | Additive (II) (λmax) | Spectral reflectivity (%) 450 mμ | 510 mμ |
|---|---|---|---|---|
| 1. Other than the invention | — | — | 65 | 70 |
| 2. Other than the invention | A-18 (434) | — | 80 | 82 |
| 3. Other than the invention | — | A-22 (441) | 82 | 83 |
| 4. The invention | A-18 (434) | A-22 (441) | 91 | 92 |
| 5. The invention | A-4 (436) | A-22 (441) | 90 | 90 |
| 6. Experiment for control | (a-1) (430) | — | 71 | 75 |
| 7. Experiment for control | — | (a-2) (435) | 73 | 76 |
| 8. Experiment for control | (a-1) (430) | (a-2) (435) | 74 | 76 |
| 9. Experiment for control | (a-1) (430) | A-22 (441) | 83 | 84 |
| 10. Experiment for control | A-16 (440) | (a-2) (435) | 81 | 83 |

In the table, it is proved that the samples having high spectral reflectivity and accordingly having less color dye stains are Samples No. 4 and No. 5 using the respective triazylstilbene type brightening agents relating to the invention whose λmax each are different from each other by not less than 4 mμ. On the other hand, it is also proved that Sample Nos. 1, 2 and 3 which are out of the invention and Sample Nos. 6, 7, 8, 9 and 10, every of which has a low spectral reflectivity and a serious color dye stain. These facts become more noticeable when observing with the naked eye.

EXAMPLE 2

Samples were prepared and evaluated in the same manner as was taken in Example 1 except that the additives were replaced as illustrated in Table 2.

TABLE 2

| Sample No. | Additive (I) (λmax) | Additive (II) (λmax) | Spectral reflectivity (%) 450 mμ | 510 mμ |
|---|---|---|---|---|
| 11. Other than the invention | — | — | 63 | 71 |
| 12. Other than the invention | A-10 (437) | — | 80 | 83 |
| 13. Other than the invention | — | A-18 (434) | 79 | 82 |
| 14. Other than the invention | A-10 (437) | A-18 (434) | 81 | 82 |
| 15. Other than the invention | A-17 (439) | — | 78 | 80 |
| 16. Other than the invention | — | A-26 (442) | 75 | 77 |
| 17. Other than the invention | A-17 (439) | A-26 (442) | 78 | 79 |
| 18. Other than the invention | A-7 (437) | A-17 (439) | 81 | 82 |
| 19. Other than the invention | A-3 (437) | A-12 (440) | 79 | 82 |
| 20. The invention | A-19 (436) | A-24 (442) | 90 | 91 |
| 21. " | A-11 | A-22 (441) | 92 | 92 |
| 22. " | A-15 (441) | A-18 (434) | 91 | 90 |
| 23. " | A-16 (440) | A-18 (434) | 91 | 91 |
| 24. " | A-19 | A-34 | 91 | 92 |
| 25. " | A-18 | A-22 | 91 | 91 |
| 26. " | A-19 | A-33 | 92 | 93 |

According to the above Table 2, it is proved that Sample Nos. 20 through 23 relating to the invention show less color dye stains represented by the spectral reflectivity than those not relating to the invention.

It is also obvious that the objects of the invention can not be achieved only if independently using a brightening agent as in Sample Nos. 12, 13, 15, 16, or only if using, in combination, triazylstilbene type brightening agents of which the respective λmax are different by not less than 4 mμ from each other as in Sample Nos. 14, 17, 18, 19.

In addition, when processing a silver halide photographic light-sensitive material by making use of the method of the invention, the excellent photographic characteristics such as sensitivity, gradation, fogginess and the like resulted.

EXAMPLE (4)

Evaluation was made in the same manner as in Example (2) except that the additives (I) and (II) which are the brightening agents used in the color developer liquid, $2.5\times10^{-4}$ mole per mole of silver halide of the sensitizing dye for the first layer of the silver halide color photographic light-sensitive material used in Example (1), and 100 mg of the antiirradiation dye per $m^2$ for the fifth layer of the light-sensitive material were added as shown in Table 4.

TABLE 4

| Sample No. | Additive (I) g/l of color developer | Additive (II) g/l of color developer | Sensitizing dye of 1st layer | Antiirradiation dye of 5th layer | Spectral reflectivity 450 mμ | 630 mμ | |
|---|---|---|---|---|---|---|---|
| 72 | A-24 1.5 g (442) | A-4 1.5 g (436) | — | — | 92 | 93 | Invention |
| 73 | A-24 1.5 g (442) | A-4 1.5 g (436) | I-16 | — | 90 | 90 | Invention |
| 74 | A-24 1.5 g (442) | A-4 1.5 g (436) | I-20 | — | 89 | 90 | Invention |
| 75 | A-24 1.5 g (442) | A-4 1.5 g (436) | I-20 | IV-10 | 88 | 88 | Invention |

TABLE 4-continued

| Sample No. | Additive (I) g/l of color developer | Additive (II) g/l of color developer | Sensitizing dye of 1st layer | Antiirradiation dye of 5th layer | Spectral reflectivity 450 mμ | 630 mμ | |
|---|---|---|---|---|---|---|---|
| 76 | A-24 1.5 g (442) | A-4 1.5 g (436) | I-20 | IV-20 | 88 | 87 | Invention |
| 77 | A-24 1.5 g (442) | A-4 1.5 g (436) | I-20 | (c) | 89 | 90 | Invention |
| 78 | A-24 1.5 g (442) | — | I-20 | IV-20 | 65 | 60 | Comparative |
| 79 | — | A-4 | I-20 | IV-20 | 68 | 62 | Comparative |
| 80 | A-24 | (a) (435) | I-20 | IV-20 | 70 | 65 | Comparative |
| 81 | A-24 | (b) (430) | I-20 | IV-20 | 72 | 65 | Comparative |
| 82 | A-24 | A-17 (439) | I-20 | IV-20 | 73 | 67 | Comparative |
| 83 | A-24 | A-25 (441) | I-20 | IV-20 | 73 | 67 | Comparative |
| 84 | A-24 | A-30 (444) | I-20 | IV-20 | 73 | 67 | Comparative |
| 85 | A-33 (443) | A-19 (436) | — | — | 93 | 93 | Invention |
| 86 | A-33 (443) | A-19 (436) | I-16 | — | 91 | 92 | Invention |
| 87 | A-33 (443) | A-19 (436) | I-20 | — | 90 | 90 | Invention |
| 88 | A-33 (443) | A-19 (436) | I-20 | IV-10 | 89 | 88 | Invention |
| 89 | A-33 (443) | A-19 (436) | I-20 | IV-20 | 89 | 87 | Invention |
| 90 | A-33 (443) | A-19 (436) | I-20 | (c) | 90 | 90 | Invention |
| 91 | A-33 (443) | — | I-20 | IV-20 | 66 | 62 | Comparative |
| 92 | — | A-19 | I-20 | IV-20 | 68 | 63 | Comparative |
| 93 | A-24 | (a) | I-20 | IV-20 | 69 | 66 | Comparative |
| 94 | A-24 | (b) | I-20 | IV-20 | 72 | 66 | Comparative |
| 95 | A-24 | A-17 | I-20 | IV-20 | 74 | 66 | Comparative |
| 96 | A-24 | A-25 | I-20 | IV-20 | 74 | 68 | Comparative |
| 97 | A-24 | A-30 | I-20 | IV-20 | 74 | 68 | Comparative |

Brightening agent (a)

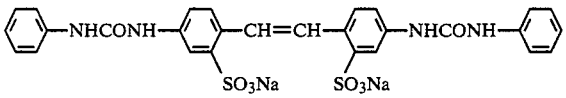

λmax 435 mμ

Brightening agent (b)

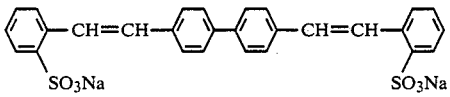

λmax 430 mμ

Antiirradiation dye (c)

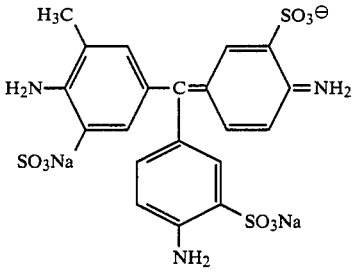

As is apparent from the results shown in Table 4, the combined or single use of the non-invention (comparative) brightening agents is unable to prevent the deterioration of the spectral reflectivity caused by the sensitizing dyes and antiirradiation dyes. On the other hand, the use of the brightening agents of this invention prevents effectively the deterioration of the spectral reflectivity by the sensitizing dyes and antiirradiation dyes.

What is claimed is:

1. A method of processing a silver halide photographic light-sensitive material which comprises exposing imagewise said material to light and thereafter processing said material with a color developer containing at least two kinds of triazylstilbene type brightening agents having maximum fluorescent wavelengths of their respective fluorescent spectra at least 4 mμ apart, wherein the concentration ratio of first brightening agents having shorter maximum fluorescent wavelengths to second brightening agents having maximum fluorescent wavelengths at least 4 mμ greater than said first agent is 5:1 to 1:5; said light-sensitive material comprising a sensitizing dye of Formula I or II and an antiirradiation dye of Formula III, IV, V, or VI

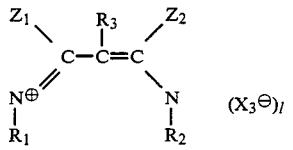

I wherein $Z_1$ and $Z_2$ each is a group of atoms necessary to form a benzoxazole, naphthoxazole, benzothiazole, naphthothiazole, benzoselenazole, naphthoselenazole, benzimidazole, naphthoimidazole, pyridine, or quinonline nucleus; $R_1$ and $R_2$ each is a group selected from the class consisting of alkyl, alkenyl, and aryl groups; $R_3$ is H, methyl or ethyl; $X_3^-$ is an anion; and l is 0 or 1;

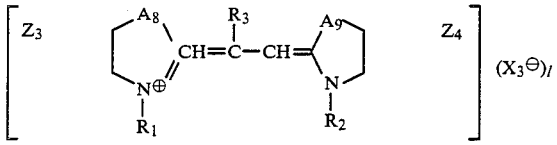

II wherein $Z_3$ and $Z_4$ each is a group of atoms necessary to form a benzene or naphthalene ring condensed with an oxazole or thiazole ring which may be substituted or unsubstituted; $R^1$—$R^3$, $X_3^-$, and l are defined as in Formula I; and $A_8$ and $A_9$ are each oxygen or sulfur;

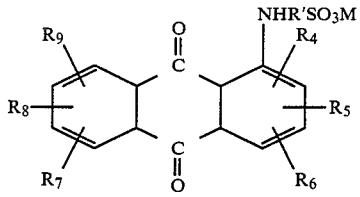

III wherein $R_4$, $R_5$, $R_6$, $R_7$, $R_8$ and $R_9$ each is hydrogen, halogen, hydroxy, an alkyl group having from 1 to 4 carbon atoms, an alkoxy group, —$SO_3M$, or —NHR-'$SO_3M$, wherein R' is an alkylene group and M is a cation of an alkali metal, of ammonium, or of an organic ammonium salt;

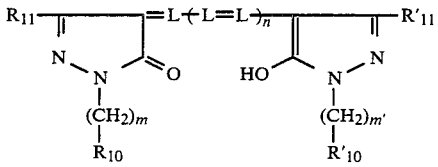

IV wherein $R_{10}$ and $R_{10'}$ are each H, alkyl, or substituted or unsubstituted aryl or heterocyclic; $R_{11}$ and $R_{11'}$ are each hydroxy, alkoxy, substituted alkoxy, cyano, —$CF_3$, —$COOR_{12}$, —$CONHR_{12}$, —$NHCOR_{12}$, amino, substituted amino, or cyclic amino represented by

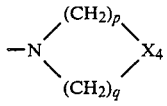

in which $R_{12}$ is H, alkyl, or substituted or unsubstituted aryl, p and q are each 1 or 2, and $X_4$ is oxygen, sulfur, or —$CH_2$—; L is an unsubstituted or substituted methine; n is 0, 1, or 2; and m and m' are each 0 or 1;

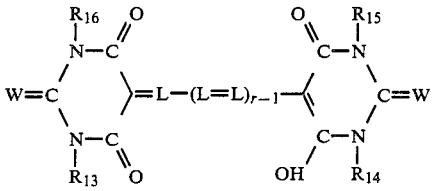

V wherein r is an integer of 1-3; W is oxygen or sulfur; L is as defined in Formula IV; and $R_{13}$-$R_{16}$ are independently H, alkyl, substituted alkyl, substituted or unsubstituted aryl, aralkyl, or heterocyclic groups; and

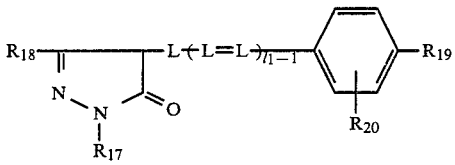

VI wherein $l_1$ is 1 or 2; $R_{17}$ is selected from the same group as $R_{10}$ in Formula IV; L is as defined in Formula IV; $R_{18}$ is alkyl group and selected from the same group as $R_{11}$ of Formula IV; $R_{19}$ is —$OZ_5$ or

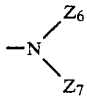

wherein $Z_5$-$Z_7$ are independently H, or alkyl, and $Z_6$ and $Z_7$ can combine with each other to form a ring; and $R_{20}$ is H, alkyl, Cl, or alkoxy.

2. The method of claim 1, wherein one of said two kinds of triazylstilbene type brightening agents has a maximum fluorescent wavelength in its fluorescent spectrum in the range of 433 to 438 mμ and the second of said two kinds of triazylstilbene brightening agents has a maximum fluorescent wavelength in its fluorescent spectrum in the range of 439 to 443 mμ.

3. The method of claim 1, wherein said triazylstilbene type brightening agents have the following Formula (VII);

VII

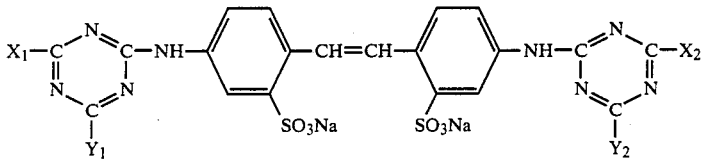

wherein $X_1$, $X_2$, $Y_1$ and $Y_2$ respectively represent hydroxy, halogen, morpholino, alkoxy, aryloxy, alkyl, aryl, amino, alkylamino, or arylamino.

4. The method of claim 1, wherein said triazylstilbene type brightening agents are present in an aggregate amount of 0.5 to 10 g per liter of processing liquid.

5. The method of claim 1, wherein said color developer contains a p-phenylenediamine type color developing agent.

6. The method of claim 1, wherein the maximum fluorescent wavelengths of said two kinds of triazylstilbene type brightening agents are different from each other by 4 to 10 mμ.

7. The method of claim 1, wherein said triazylstilbene type brightening agents are present in an aggregate amount of from 0.3 to 10 g per liter of color developer.

8. The method of claim 1, wherein said sensitizing dye is present in an amount of about $2\times10^{-6}$ to about $1\times10^{-3}$ mole per mole of silver halide.

9. The method of claim 1, wherein said antiirradiation dye is present in an amount of about 1 to about 800 mg per $m^2$ of light sensitive material.

* * * * *